US008235753B2

(12) United States Patent
Tanaka et al.

(10) Patent No.: US 8,235,753 B2
(45) Date of Patent: Aug. 7, 2012

(54) CONTACT, AND CARD ADAPTOR AND CARD CONNECTOR HAVING THE SAME

(75) Inventors: Akihiro Tanaka, Osaka (JP); Yasuo Nakai, Osaka (JP)

(73) Assignee: Hosiden Corporation, Yao-shi, Osaka (JP)

( * ) Notice: Subject to any disclaimer, the term of this patent is extended or adjusted under 35 U.S.C. 154(b) by 0 days.

(21) Appl. No.: 13/351,805

(22) Filed: Jan. 17, 2012

(65) Prior Publication Data

US 2012/0115368 A1 May 10, 2012

Related U.S. Application Data

(62) Division of application No. 11/987,040, filed on Nov. 27, 2007, now Pat. No. 8,109,794.

(30) Foreign Application Priority Data

Dec. 6, 2006 (JP) ..... 2006-329702

(51) Int. Cl.
*H01R 14/00* (2006.01)

(52) U.S. Cl. ..... 439/630; 439/862

(58) Field of Classification Search ..... 439/863, 439/630, 621
See application file for complete search history.

(56) References Cited

U.S. PATENT DOCUMENTS

| | | | | |
|---|---|---|---|---|
| 6,955,548 | B1 | 10/2005 | Wang | |
| 6,971,918 | B1 | 12/2005 | Su | |
| 7,104,846 | B1 | 9/2006 | Yen | |
| 7,232,343 | B1 | 6/2007 | Lai | |
| 2001/0039129 | A1* | 11/2001 | Nishimura | 439/74 |
| 2004/0121653 | A1 | 6/2004 | Matsunaga | |
| 2004/0209519 | A1 | 10/2004 | Yokoyama | |
| 2005/0164559 | A1* | 7/2005 | Shimizu et al. | 439/630 |
| 2005/0181674 | A1 | 8/2005 | Kitamura | |
| 2006/0099856 | A1* | 5/2006 | Takei et al. | 439/630 |
| 2006/0116027 | A1 | 6/2006 | Tseng | |
| 2006/0166559 | A1 | 7/2006 | Nakai | |
| 2007/0111604 | A1 | 5/2007 | Ying | |

FOREIGN PATENT DOCUMENTS

| | | |
|---|---|---|
| CN | 1012 32132 A | 7/2008 |
| JP | 8-3992 U | 6/1992 |
| JP | 2005-209550 | 4/2005 |
| JP | 2005 15 0000 | 6/2005 |
| JP | 2006 269 102 | 10/2006 |
| KR | 2006 00845174 | 7/2006 |

* cited by examiner

*Primary Examiner* — Hien Vu
(74) *Attorney, Agent, or Firm* — Bacon & Thomas, PLLC

(57) ABSTRACT

In a contact of the present invention, a first plate spring piece portion 11*c* having a first fulcrum portion 11*b* in one side extends in a cantilevered manner from the first fulcrum portion 11*b* in a direction opposite to a card insertion direction so as to be elastically deformable in a thickness direction of the card. A second plate spring piece portion 11*e* having in one side a second fulcrum portion 11*d* which is the other side of the first plate spring piece portion 11*c* is formed in a shape where the second plate spring piece portion extends at an inclination angle from the second fulcrum portion 11*d* in the card insertion direction so as to be elastically deformable in the card thickness direction. The other side of the second plate spring piece portion 11*e* is to be contacted with the contact pad 2 of the card 1.

1 Claim, 18 Drawing Sheets

1b
1c
2
1g
1
1d
1i
1h 1b
1c
1a
2
1j
1h
1d
1f
1

1c
1a
1f
1i
1h
1d
1
1e
1g

Fig.9A
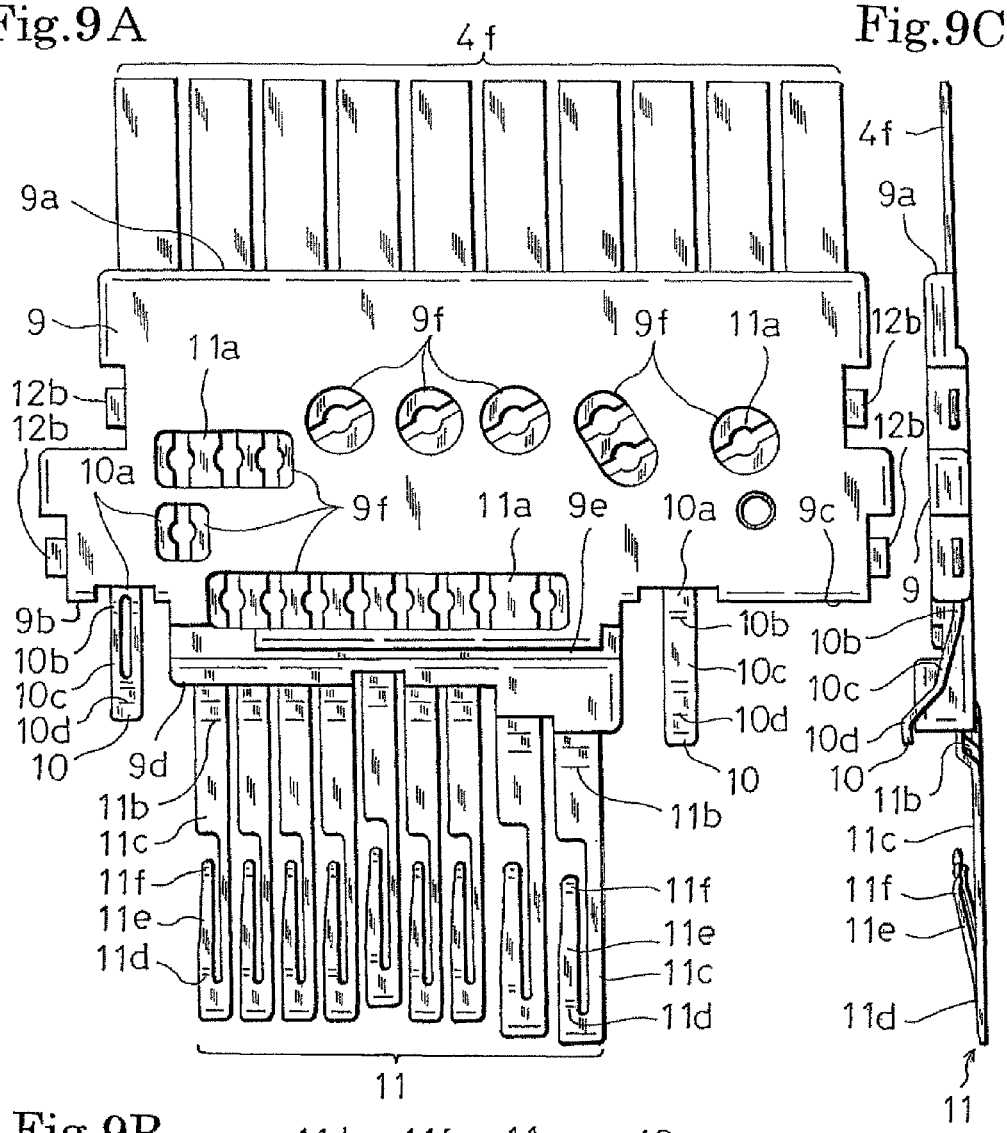
Fig.9C
Fig.9B
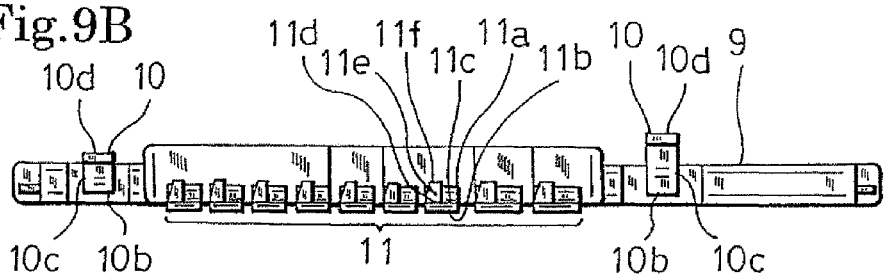

CONTACT, AND CARD ADAPTOR AND CARD CONNECTOR HAVING THE SAME

CROSS-REFERENCE TO RELATED APPLICATION

This application is a Divisional which claims the benefit of U.S. patent application Ser. No. 11/987,040, which was filed on Nov. 27, 2007.

BACKGROUND OF THE INVENTION

1. Field of the Invention

The present invention relates to a contact which is to p be contacted with a contact pad disposed on one principal face of a card such as a memory card, and also to a card adaptor and card connector having such a contact.

2. Description of the Prior Art

There are a card connector for connecting a memory card to an electronic apparatus, and a card adaptor for connecting a memory card according to another standard in which the size is more reduced than a certain standard in which the size reduction is not specified, to another card connector corresponding to another memory card according the certain standard. In a card insertion space of the card connector or the card adaptor, contacts (contact members) each configured by a metal plate spring having superior electrical conductivity are disposed so as to be contacted respectively with plural contact pads which are juxtaposedly arranged on one principal face of a card.

A conventional contact has a fulcrum portion which supports a load, in one side, and is formed into a simple cantilevered shape which extends from the fulcrum portion at a certain inclination angle, in a direction that is opposite to the card insertion direction. The other side of the contact is pressed against a contact pad of a card to attain a contact state.

Such a conventional contact, and a conventional card adaptor and card connector having it are disclosed in, for example, Japanese Patent Application Laying-Open Nos. 2005-150000 and 2006-269102.

SUMMARY OF THE INVENTION

The situation of a card contacting contact is as follows. Because of miniaturization and thinning of an electronic apparatus typified by a portable telephone, and those of a card itself, also a contact is miniaturized, and the displacement amount of a contact is further suppressed. Accordingly, it is difficult to ensure a sufficient contact pressure (a contact pressure is proportional to a contact displacement amount in accordance with Hook's law).

A conventional contact is of the opposed type which is formed into a simple cantilevered shape. There is the possibility that buckling is caused by card insertion. The contact displacement amount cannot be increased more than a certain level. In order to ensure a sufficient contact pressure, consequently, there is no choice but to increase the spring constant.

As apparent from the relationship of a contact pressure F (N) of a contact and a displacement amount x (mm) shown in FIG. 18, when the spring constant k of a contact is increased, however, the range of a displacement amount where an adequate contact pressure can be obtained is narrowed (B<A). Therefore, a stable contact pressure cannot be obtained unless the position of a contacting portion is strictly managed to suppress dispersions, and it is difficult to ensure a stable contact pressure. Structurally, a stress is concentrated to one portion (one fulcrum portion), and a generated stress is made larger in accordance with an increase of the spring constant k. Therefore, the life period is shortened.

The problem which is to be solved by the invention is that the conventional contact shape cannot ensure a stable contact pressure and a long life period.

In order to solve the problem, the contact of the invention is a contact which is to be placed in a card insertion space and contacted with a contact pad which is disposed on one principal face of a card, wherein a first plate spring piece portion having a first fulcrum portion in one side extends in a cantilevered manner from the first fulcrum portion in a direction opposite to a card insertion direction so as to be elastically deformable in a thickness direction of the card, a second plate spring piece portion having in one side a second fulcrum portion which is another side of the first plate spring piece portion is formed in a shape where the second plate spring piece portion extends at an inclination angle in a cantilevered manner from the second fulcrum portion in the card insertion direction so as to be elastically deformable in the card thickness direction, and another side of the second plate spring piece portion is to be contacted with the contact pad of the card. The plate spring piece portion (second plate spring piece portion) which is to be contacted with the contact pad of the card is configured as the unopposed type in which the portion extends at an inclination angle in a cantilevered manner from the fulcrum portion (second fulcrum portion) in the card insertion direction (forward direction). Therefore, the possibility that buckling is caused by card insertion can be eliminated, and the contact pressure can be increased or decreased in accordance with increase or decrease of a displacement amount of the contact. Consequently, a sufficient contact pressure can be ensured even when the spring constant of the contact is not increased, the range of a displacement amount where an adequate contact pressure can be obtained is not narrowed, and it is not required to strictly manage the position of a contacting portion to suppress dispersions. As a result, a stable contact pressure of the contact can be easily ensured. Structurally, a stress can be dispersed to two portions (the first fulcrum portion of the first plate spring piece portion and the second fulcrum portion of the second plate spring piece portion), and in addition a generated stress can be suppressed to a low level by not increasing the spring constant. This stress relaxation can prolong the life period of the contact. Therefore, a long life period of the contact can be easily ensured.

In the contact of the invention, the second plate spring piece portion may be formed in a shape where it is folded back from the other side of the first plate spring piece portion, or preferably the second plate spring piece portion may be formed by partly cutting and raising the first plate spring piece portion. In this configuration, the second plate spring piece portion can directly extend at an inclination angle in a cantilevered manner from the other side of the first plate spring piece portion in the card insertion direction (forward direction), without passing through a folded back portion (radius of curvature). Therefore, a larger displacement amount of the contact can be obtained, and a stable contact pressure of the contact can be ensured more easily. Preferably, an attaching portion to a case member for forming a card insertion space may be continuously integrated with the first fulcrum portion of the first plate spring piece portion. Preferably, an external connection terminal may be continuously integrated with the attaching portion.

The card adaptor of the invention comprises the above-described contact of the invention, and the case member for forming the card insertion space constitutes an adaptor body having an external shape for another card which is larger than the card that is to be inserted into the card insertion space.

Therefore, a stable contact pressure and a long life period can be easily ensured in the contact for card contact disposed in the card adaptor.

The card connector of the invention comprises the above-described contact of the invention, and the case member for forming the card insertion space constitutes a connector housing having a box-like shape configured by an insulative lower case to which the contact is attached, and a conductive upper case which is coveringly attached to the lower case. Therefore, a stable contact pressure and a long life period can be easily ensured in the contact for card contact disposed in the card connector.

BRIEF DESCRIPTION OF THE DRAWINGS

FIG. 9A is a plan view showing the contact group disposed in the card adaptor, FIG. 9B is a front view, and FIG. 9C is a side view;

DETAILED DESCRIPTION OF THE PREFERRED EMBODIMENT

Hereinafter, an embodiment of the connector and card adaptor having it according to the invention will be described with reference to FIGS. 1 to 12. The embodiment is a card adaptor for connecting a memory card according to a certain standard in which size reduction is not specified, for example, Memory Stick PRO Duo (a trademark of Sony Corporation) (hereinafter, referred to as "large card"), to a card connector corresponding to another memory card according to another standard in which the size is more reduced than the certain standard, for example, Memory Stick Micro (a trademark of Sony Corporation) (hereinafter, referred to as "small card").

Figures 1A, 1B, 1C:
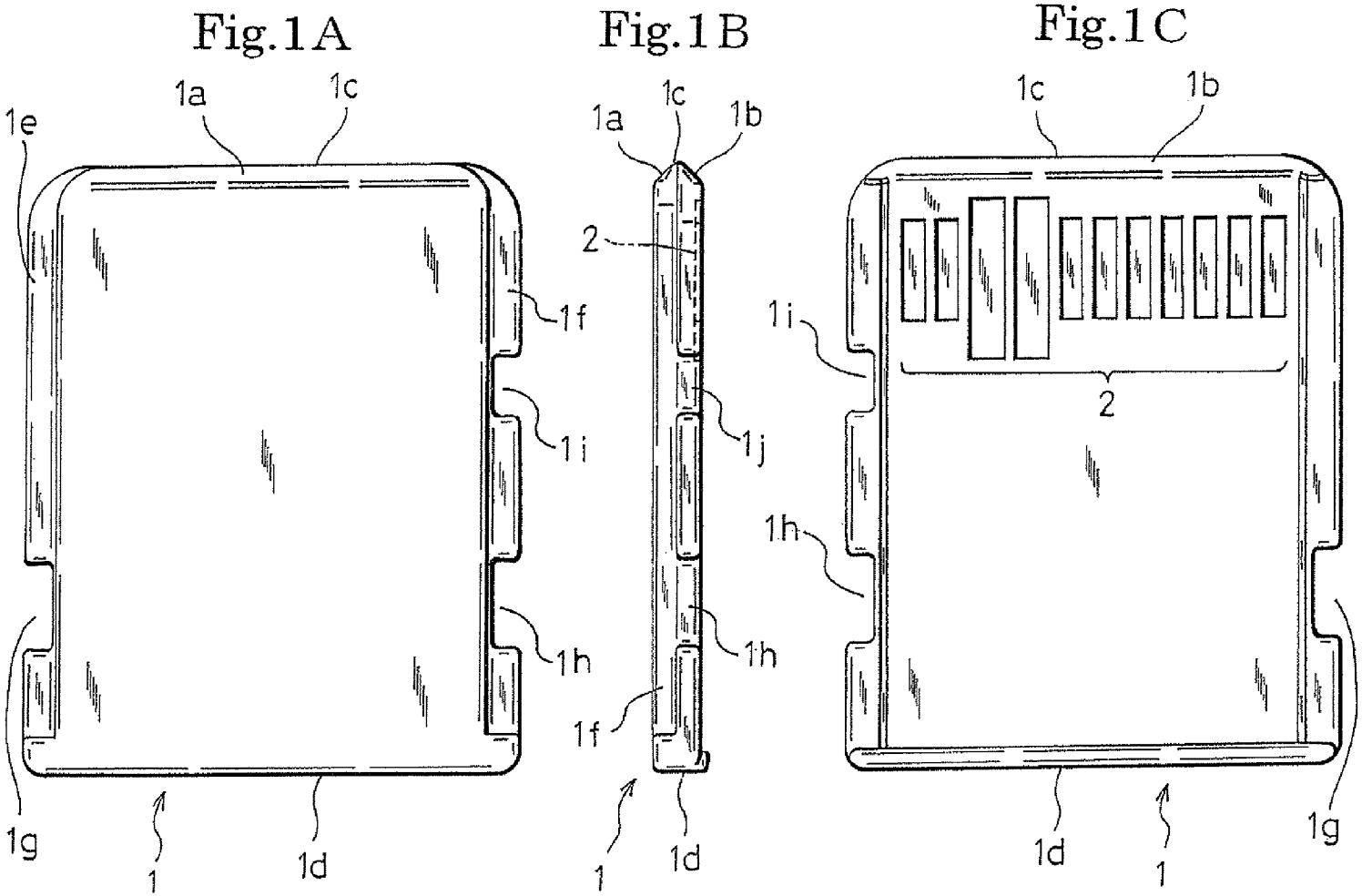
FIG. 1A is a front view showing a card to be used with a card adaptor of the embodiment of the invention.
FIG. 1B is a side view.
FIG. 1C is a rear view.

As shown in FIG. 1, the small card 1 comprises: a front end portion 1*c* which, when the card is inserted into a card connector corresponding to the small card 1 or the card adaptor of the embodiment, is positioned in the front side, and which has tapered portions 1*a*, 1*b* in the upper and lower portions, respectively to be formed in a forward-narrowed section shape; and a rear end portion 1*d* which is positioned in the rear side, and which is configured by a flat face. Step portions 1*e*, 1*f* are formed in right and left side edge portions, respectively. The step portions cooperate with the rear end portion 1*d* to prevent erroneous insertion in an inverted front and rear or surface and rear face relationship into a card connector corresponding to the small card 1 or the card adaptor of the embodiment, from occurring. Recesses 1*g*, 1*h* for, when the card is inserted into a card connector corresponding to the small card 1, holding the small card 1 to an attachment position of the card connector are formed in the step portions 1*e*, 1*f* on the side of the rear end portion 1*d*. A recess 1*i* for, when the card is inserted into the card adaptor of the embodiment, holding the small card 1 to an attachment position of the card adaptor of the embodiment is formed in the right step portion 1*f* in FIG. 1A on the side of the front end portion 1*c* with respect to the recess 1*h*. Plural (eleven) contact pads 2 for external connection are juxtaposedly arranged on the rear face (one principal face) on the side of the front end portion 1*c*.

Figure 2:
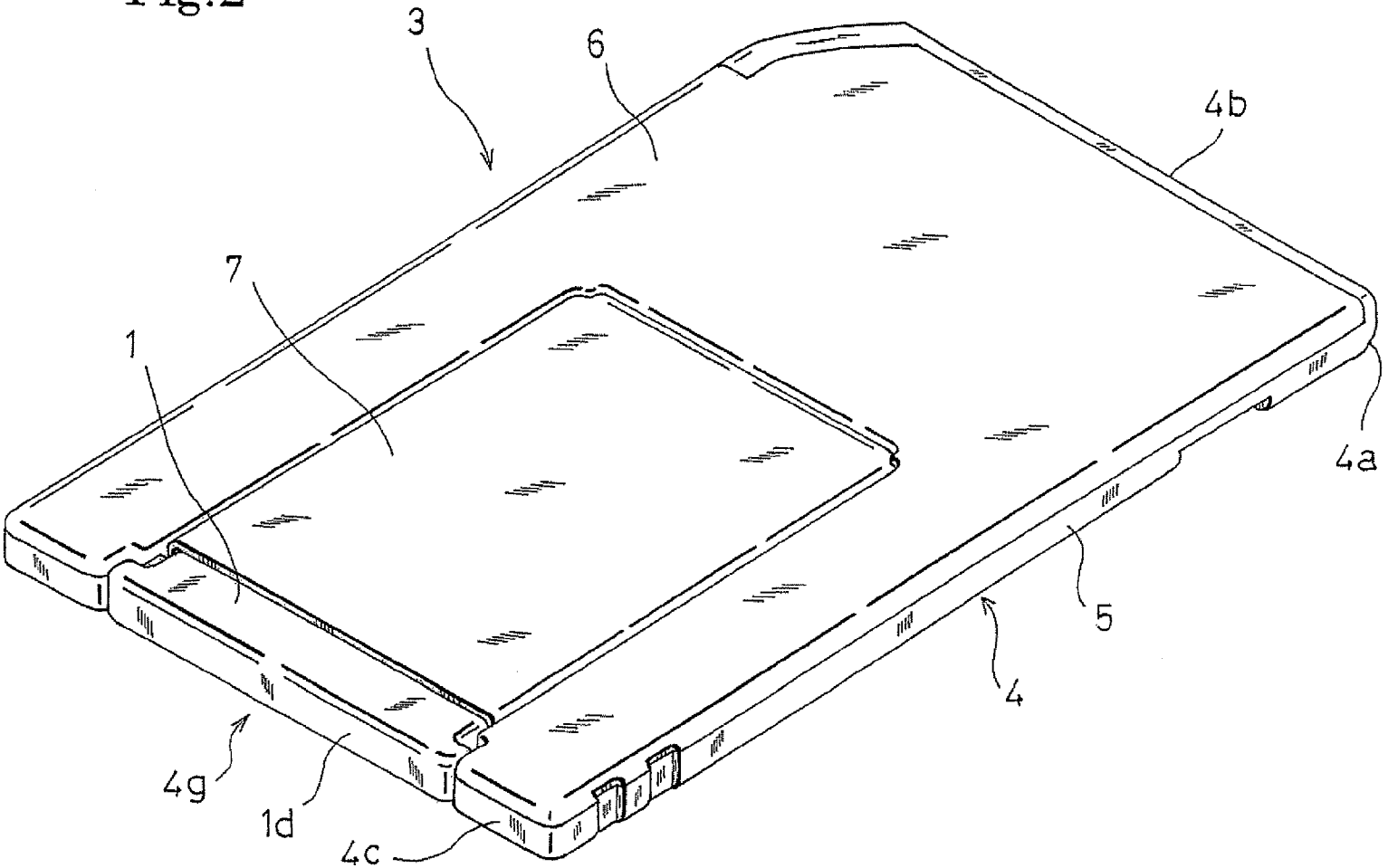
FIG. 2 is a perspective view showing the appearance of the front side of the card adaptor.
Figure 3:
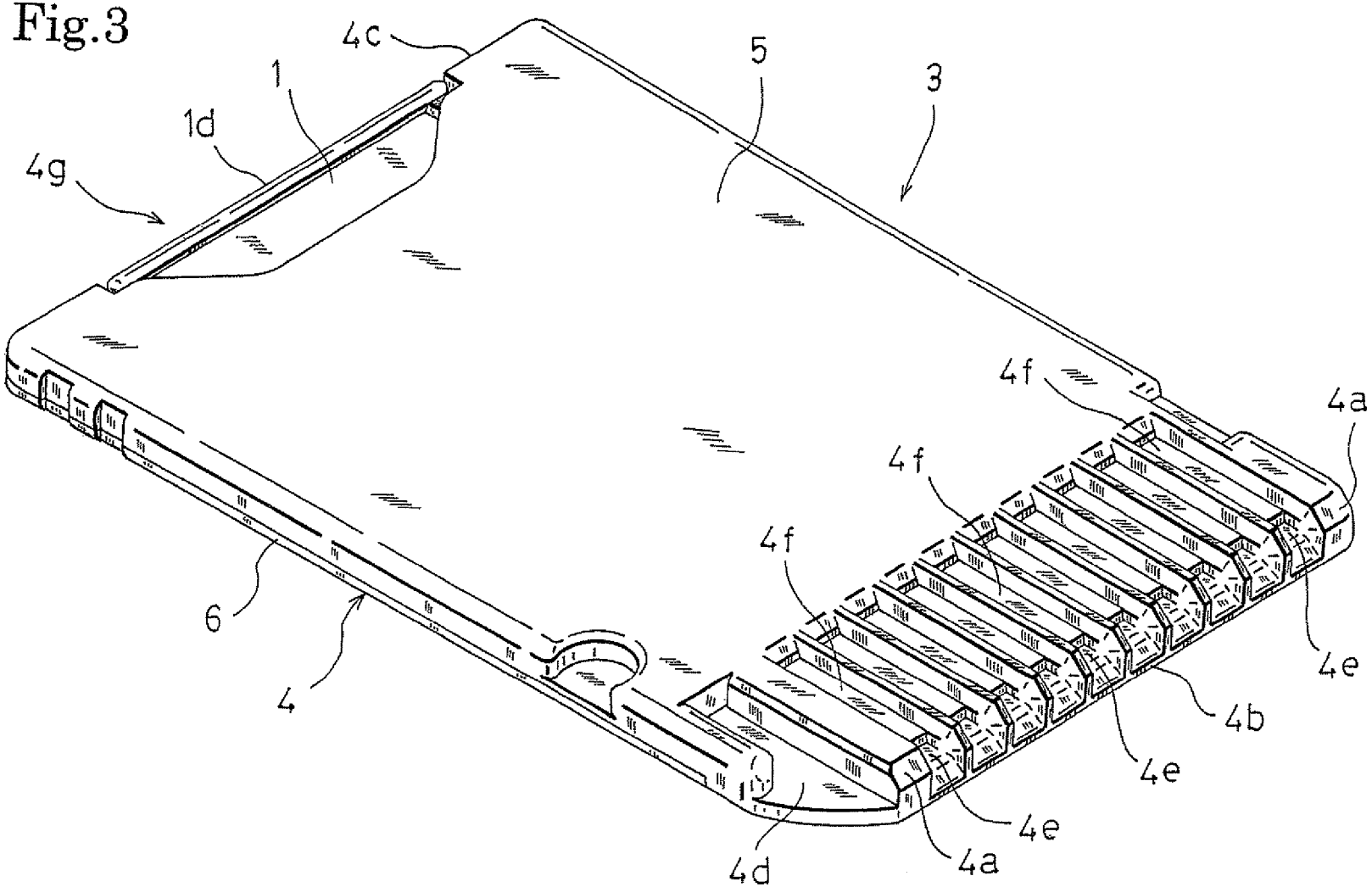
FIG. 3 is a perspective view showing the appearance of the rear side of the card adaptor.

As shown in FIGS. 2 and 3, in the card adaptor 3 of the embodiment, an adaptor body 4 in which the small card 1 is detachably attached has an external shape for the large card, so that the card adaptor can be connected to a card connector corresponding to the large card. In the same manner as the large card, namely, the adaptor body 4 comprises: a front end portion 4*b* which, when inserted into a card connector corresponding to the large card, is positioned in the front side, and which has a tapered portions 4*a* in the lower portion; and a rear end portion 4*c* which is positioned in the rear side, and which is configured by a flat face. In order to prevent erroneous insertion in an inverted front and rear or surface and rear face relationship into a card connector corresponding to the large card, the adaptor body has an edge removal portion on the side of the front end portion 4*b* and in a left end portion in FIG. 2. A recess 4*d* which forward and downward opens is formed in the rear face (one principal face) immediately rear of the edge removal portion. On the rear face on the side of the front end portion 4*b*, plural (ten) recesses 4*e* which forward and downward open, and which are used for protecting external connection terminals are formed in juxtaposition to the recess 4*d* for preventing erroneous insertion. Plural (ten) external connection terminals 4*f* are disposed in bottom portions of the recesses 4*e* for protecting the external connection terminals, respectively, so that the external connection terminals 4*f* are juxtaposed on the rear face (one principal face) on the side of the front end portion 4*b*. In the thus configured adaptor body 4, a card insertion port 4*g* through which the small card 1 is to be inserted is formed in a side face on the side of the rear end portion 4*c*.

Figure 4:
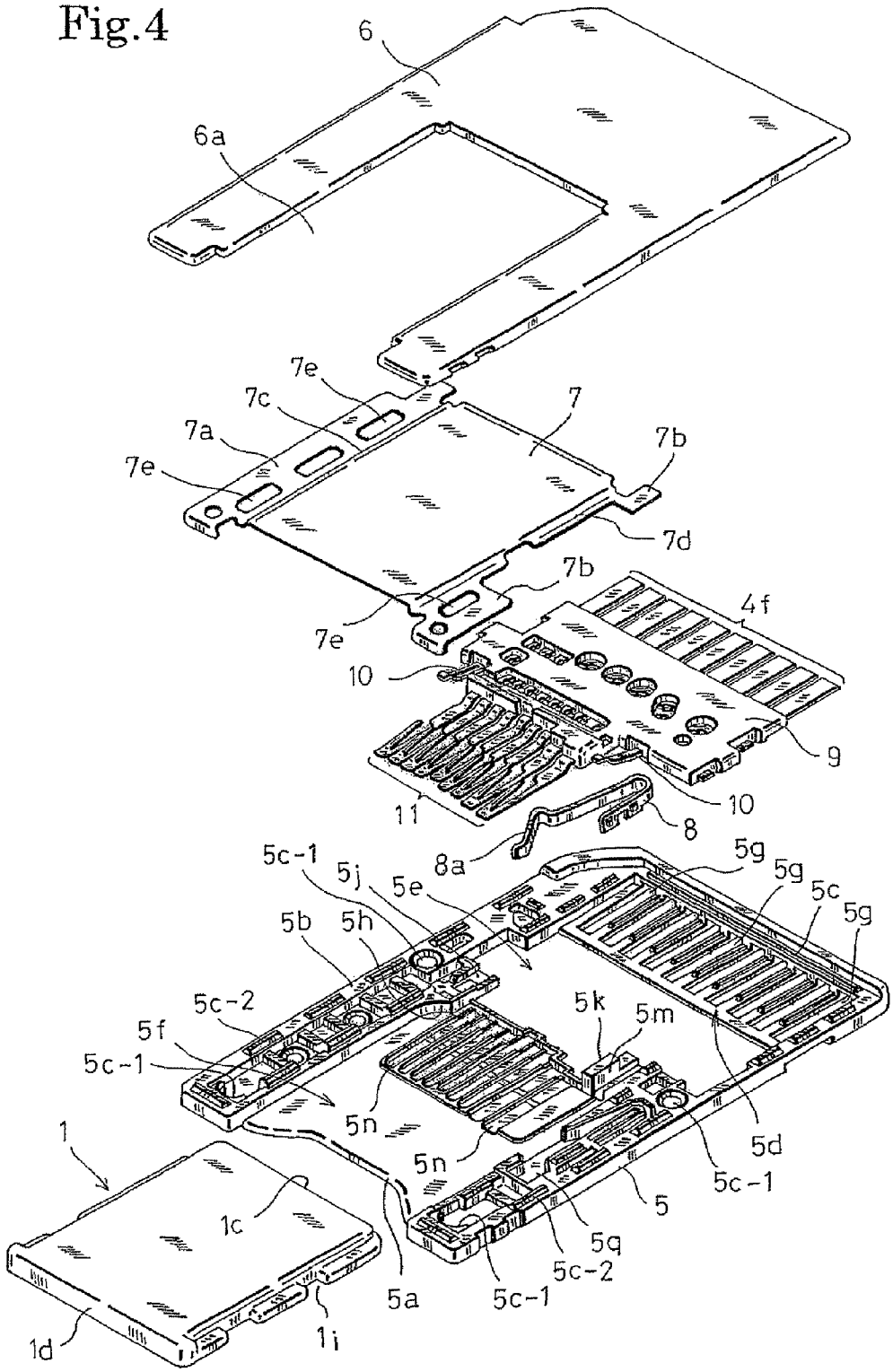
FIG. 4 is a perspective view showing a disassembled state of the card adaptor.

As shown in FIG. 4, the card adaptor 3 of the embodiment is configured by: a lower case 5 which has a one-piece structure, and which is made of an insulative synthetic resin; an upper case which has a two-piece structure, and which cooperates with the lower case 5 to constitute the adaptor body 4, i.e., a resin cover 6 made of an insulative synthetic resin, and a metal cover 7 configured by a conductive metal plate for applying countermeasures against electrostatic breakdown and noise; a lock spring 8 which is incorporated in the adaptor body 4, and which is used for holding the small card 1 to the attachment position of the adaptor body 4; plural (two) shield contacts 10 which are integrally held by an insulator 9 made of an insulative synthetic resin to be incorporated in the adaptor body 4, and which are contacted with the metal cover 7 to conductively connect the external connection terminals 4*f* at the both ends; and plural (nine) card contacting contacts 11 of the invention which are to be contacted with the contact pads 2 of the small card 1 to be conductively connected to the corresponding external connection terminals 4*f*.

Figure 5:
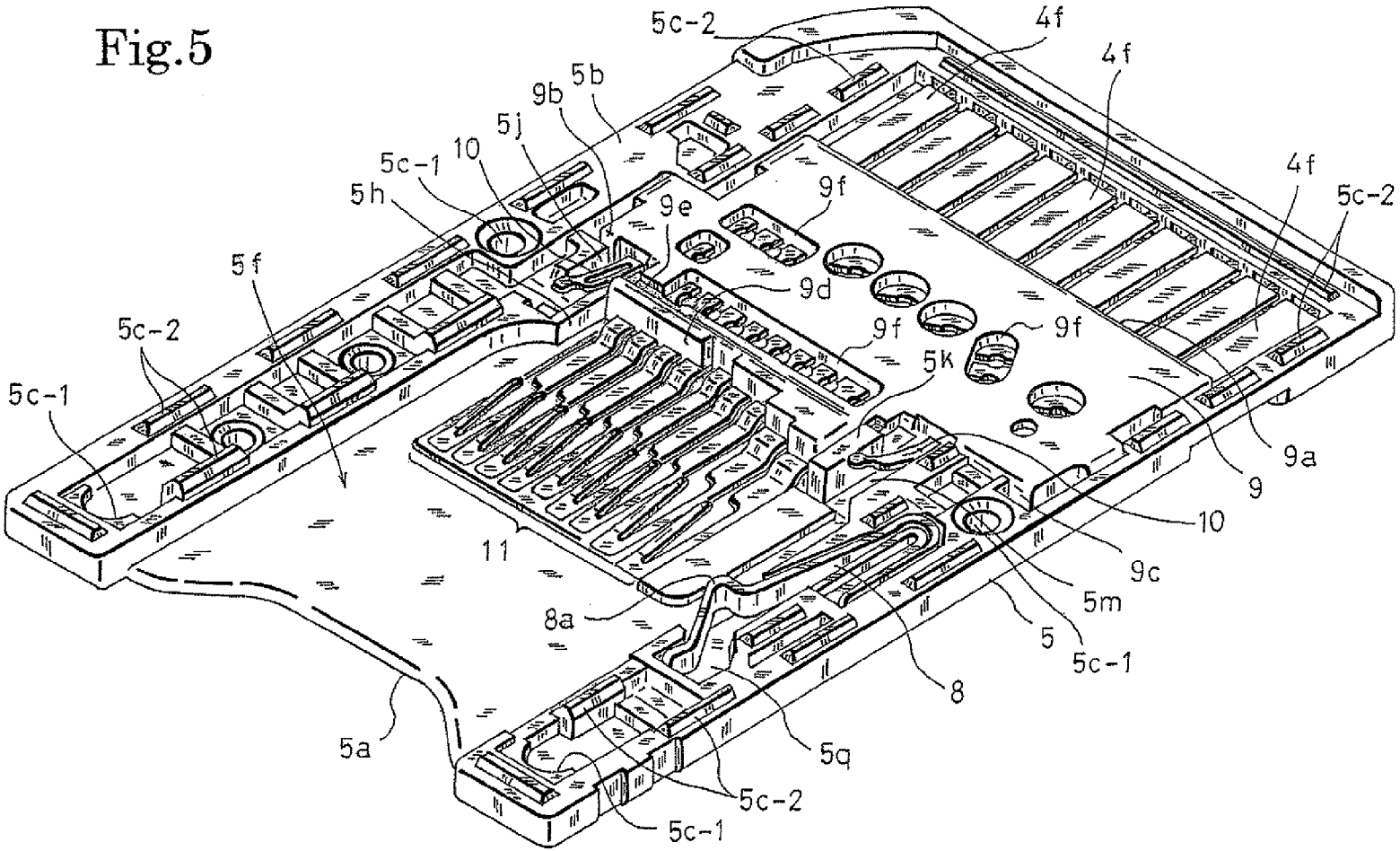
FIG. 5 is a perspective view showing an internal structure of the card adaptor.

As shown in FIGS. 4 and 5, the lower case 5 is formed by integrating a bottom wall 5*a*, and a side wall 5*b* which upstands from front, right, and left side edge portions of the bottom wall 5*a* with one another. Plural upper-case positioning recesses 5*c*-1 are disposed in the side wall 5*b*, and plural upper-case welding protrusions 5*c*-2 are upward projected from an upper portion of the side wall 5*b*. Inside the lower case 5, an external-connection terminal attaching portion 5*d* for positioning and supporting the external connection terminals 4*f* is formed on the side of the front end portion. An insulator attaching portion 5*e* for positioning and supporting the insulator 9 is formed communicatingly and continuously in rear of the external-connection terminal attaching portion 5*d*. A card insertion space 5*f* is formed communicatingly and continuously in rear of the insulator attaching portion 5*e*. The rear end side of the card insertion space 5*f* is communicatingly connected to the card insertion port 4*g*. Plural (ten) external-connection terminal exposing holes 5*g* which penetrate respectively to the recesses 4*e* for protecting the external connection terminals are juxtaposed in the bottom face of the external-connection terminal attaching portion 5*d*. In the side wall 5*b*, a stopper portion 5*h* which is partly projected from a left edge portion in FIG. 4, and which is used for, when the small card 1 is to be inserted into the card insertion space 5*f*, receiving the front end portion is of the small card 1 to restrict the insertion of the small card 1 is formed on the side of a rear end portion of the insulator attaching portion 5*e*. In the thickness of the stopper portion 5*h*, a contact attaching portion 5*j* to which one of the shield contacts 10 is to be attached is continuously communicated with the insulator attaching portion 5*e*. In the bottom wall 5*a*, a stopper portion 5*k* which upstans in an island-like manner in the vicinity of the right edge in FIG. 4, and which is used for, when the small card 1 is to be inserted into the card insertion space 5*f*, receiving the front end portion is of the small card 1 to restrict the insertion of the small card 1 is formed on the rear end side of the insulator attaching portion 5*e*. In a gap between the side wall 5*b* and the stopper portion 5*k* which is disposed on the rear end side of the insulator attaching portion 5*e* and in the right edge in FIG. 4, a contact attaching portion 5*m* to which the other shield contact 10 is to be attached is continuously communicated with the insulator attaching portion 5*e* and the card insertion space 5*f*. In the bottom face of the card insertion space 5*f*, plural (nine) thin contact housing grooves 5*n* which correspond respectively to the card contacting contacts 11, and which extend in the anteroposterior direction (in the card insertion and extraction direction) are juxtaposed on the side of the front end portion (inner side). In the thickness of the side wall 5*b* which is on the right side in FIG. 4 in the card insertion space 5*f*, a lock-spring attaching portion 5*q* to which the lock spring 8 is to be attached is formed, and a rear end portion side of the lock-spring attaching portion 5*q* is communicatingly connected to the card insertion space 5*f*.

In the upper case of the two-piece structure configured by the resin cover 6 and the metal cover 7, as shown in FIGS. 2, 4, 6, and 7, the resin cover 6 has a cutaway portion 6*a* the size of which corresponds to the card insertion space 5*f*, in the rear end side, and is formed into a substantially U-like shape which rearward opens so that an upper portion of the lower case 5 other than the card insertion space 5*f* is covered by the resin cover 6, and an upper portion of the card insertion space 5*f* is covered by the metal cover 7, and the metal cover 7 is formed into a rectangular shape in accordance with the shape of the cutaway portion 6*a* of the resin cover 6, so as to be fittable into the cutaway portion 6*a*. On the inner surface of the resin cover 6, formed are plural upper-case positioning protrusions which are not shown, and which are to be fitted to the upper-case positioning recesses 5*c*-1 of the lower case 5, respectively, and plural upper-case welding recesses which are not shown, and which are to be fitted to the upper-case welding protrusions 5*c*-2 of the lower case 5, respectively. Fixing pieces 7*a*, 7*b* which are to overlap with an upper portion of the side wall 5*b* of the lower case 5 that are on the left and right sides of the card insertion space 5*f* are integrally continuous to left and right side edge portions of the metal cover 7 while being stepped down through step portions 7*c*, 7*d*, respectively. In the fixing pieces 7*a*, 7*b*, plural vertically penetrating engaging holes 7*e* which are used for positioning the metal cover, and which are to be fitted onto the upper-case welding protrusions 5*c*-2 of the lower case 5 in the right and left sides of the card insertion space 5*f* are formed. A front end portion of the metal cover 7 is downward bent to be formed as an engaging piece 7*f* for positioning the metal cover.

As shown in FIGS. 4 and 5, the lock spring 8 is configured by a metal plate spring which is bent into a substantially U-like shape. An engaging portion 8*a* which is formed by bending the metal plate spring along the longitudinal direction into a mountain-like shape is disposed in one end portion of the lock spring 8.

Figure 6:
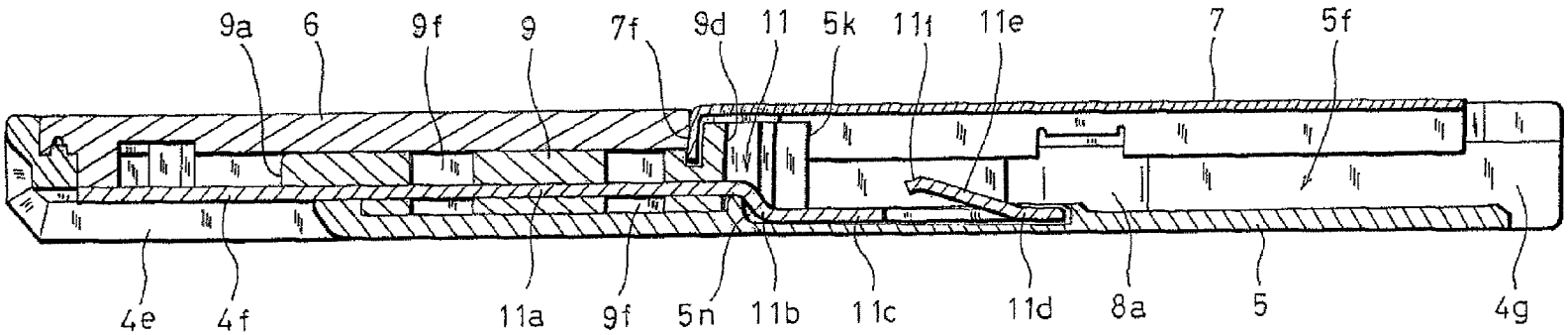
FIG. 6 is a section view showing the internal structure of the card adaptor.

The card adaptor 3 of the embodiment is assembled in the following manner. As shown in FIG. 5, the lock spring 8 is attached to the lock-spring attaching portion 5*q* of the lower case 5, and the engaging portion 8*a* is projected by the elastic force of the lock spring 8 from the communication portion between the rear end portion of the lock-spring attaching portion 5*q* and the card insertion space 5*f*, into the card insertion space 5*f*. The insulator 9 is attached to the insulator attaching portion 5*e* of the lower case 5, and the shield contacts 10 and the card contacting contacts 11 are collectively attached together with all the external connection terminals 4*f* to the lower case 5. Thereafter, while the engaging holes 7*e* of the metal cover 7 are fitted onto the upper-case welding protrusions 5*c*-2 of the lower case 5, and the engaging piece 7*f* of the front end portion of the metal cover 7 is fitted into an engaging groove which will be described later, and which is formed in the insulator 9, the fixing pieces 7*a*, 7*b* of the metal cover 7 are superimposed on the upper portion of the side wall 5*b* of the lower case 5 which is on the right and left sides of the card insertion space 5*f*, and the upper portion of the card insertion space 5*f* is covered by the metal cover 7. Then, while the upper-case positioning protrusions and upper-case welding recesses of the resin cover 6 are fitted to the upper-case positioning recesses 5*c*-1 and upper-case welding protrusions 5*c*-2 of the lower case 5, and the metal cover 7 is fitted to the cutaway portion 6*a* of the resin cover 6, the upper portion of the lower case 5 other than the card insertion space 5*f* is covered by the resin cover 6 in a state where the fixing pieces 7*a*, 7*b* of the metal cover 7 and the insulator 9 are clamped with the lower case 5. As shown in FIGS. 2 and 6, the whole of the upper portion of the lower case 5 is covered by the upper case of the two-piece structure configured by the resin cover 6 and the metal cover 7. After the upper portion of the lower case 5 other than the card insertion space 5*f* is covered by the resin cover 6, then, the upper-case welding protrusions 5*c*-2 of the lower case 5 and the upper-case positioning protrusions of the resin cover 6 in the fitting state are ultrasonic welded to each other to fix the upper case of the two-piece structure configured by the resin cover 6 and the metal cover 7, to the upper portion of the lower case 5, and form the adaptor body 4, thereby completing the assembly.

In the thus assembled card adaptor 3 of the embodiment, as shown in FIGS. 2 and 3, the adaptor body 4 has the external shape for the large card, and the card insertion port 4*g* is formed in the side face on the side of the rear end portion 4*c*. As shown in FIG. 5, the lock spring 8 is incorporated in the adaptor body 4, and the shield contacts 10 and the card contacting contacts 11 are collectively incorporated together with all the external connection terminals 4*f* into the adaptor body 4 through the insulator 9. Furthermore, the card insertion space 5*f* which has the front end portion closed by the insulator 9 and the rear end portion that is exposed to the outside by the card insertion port 4*g* is formed in rear of the insulator 9 in the adaptor body 4. As shown FIGS. 2, 3, and 6, the small card can be inserted and attached into the card insertion space 5*f* through the card insertion port 4*g* of the adaptor body 4.

Figure 10A:
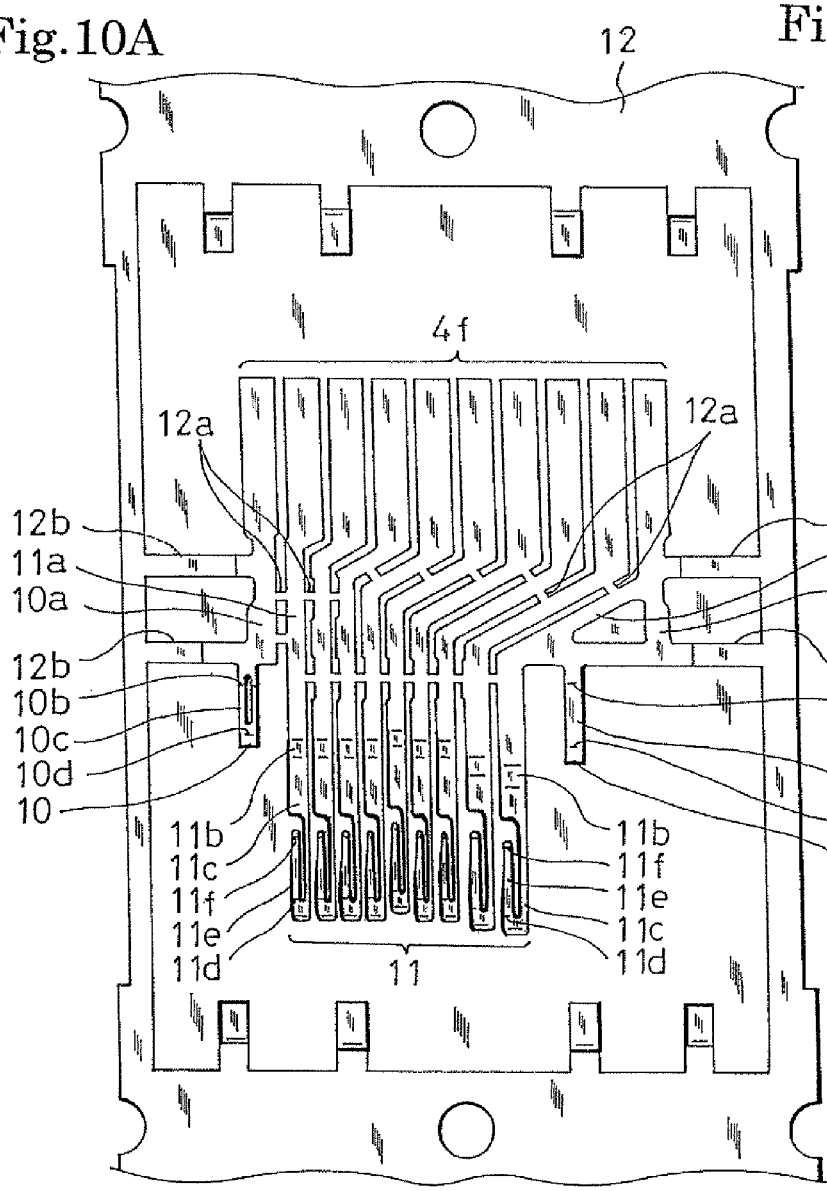
FIG. 10A is a plan view showing a hoop material in which the contact group disposed in the card adaptor is molded.
Figure 10C:
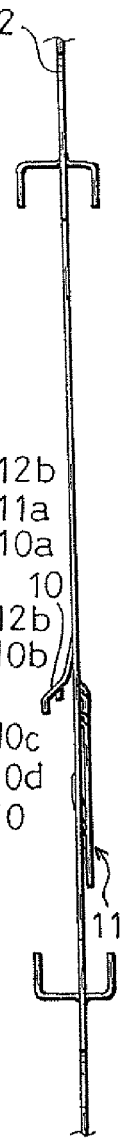
FIG. 10C is a side view.
Figure 10B:
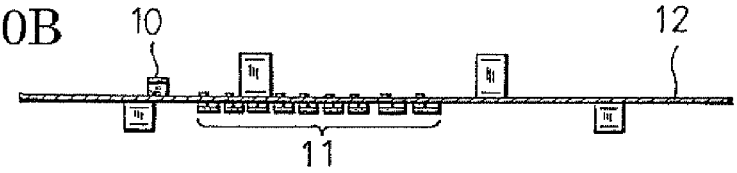
FIG. 10B is a section view.

The contact group disposed in the card adaptor 3 of the embodiment, i.e., the two shield contacts 10 and the nine card contacting contacts 11 are molded in a state where, as shown in FIG. 10, the contacts are integrally coupled to each other in a parallel manner by applying a punching process on a hoop material 12 made of a spring material having superior electrical conductivity. In this molded state, the two shield contacts 10 are formed in the right and left ends of the contact group, and the nine card contacting contacts 11 are formed in parallel between the two shield contacts 10. In each of the shield contacts 10, an attaching portion 10*a* for the adaptor body 4 is formed in an intermediate portion, and, also in each of the card contacting contacts 11, an attaching portion 11*a* for the adaptor body 4 is formed in an intermediate portion. The attaching portion 10*a* of the right shield contact 10 in FIG. 10 is formed integrally with the attaching portion 11*a* of the right-end card contacting contact 11 in FIG. 10. Plural connecting portions 12*a* each of which integrally couples adjacent attaching portions together are formed between the attaching portion 10*a* of the left shield contact 10 in FIG. 10 and the attaching portion 11*a* of the left-end card contacting contact 11 in FIG. 10, and between the attaching portions 11*a* of the card contacting contacts 11. Plural connecting portions 12*b* which integrally connect the two shield contacts 10 and nine card contacting contacts 11 (contact group) that are integrally coupled, to one another with the hoop material (carrier) 12 are formed between the attaching portions 10*a* of the shield contacts 10 and the hoop material 12.

In one end side of each of the attaching portion 10*a* of the left shield contact 10 in FIG. 10 and the attaching portions 11*a* of the nine card contacting contacts 11, the external connection terminal 4*f* is integrally continuously formed, so that the plural (ten) external connection terminals 4*f* are arranged in parallel in the one-end side of the two shield contacts 10 and nine card contacting contacts 11 (contact group) that are integrally coupled. The right-end external connection terminal 4*f* in FIG. 10 is an external connection terminal which is common to the right shield contact 10 in FIG. 10 and the right-end card contacting contact 11 in FIG. 10.

In each of the attaching portions 10*a* of the shield contacts 10, a bending portion is formed on the other end side, a plate spring piece portion 10*c* which has a fulcrum portion 10*b* for supporting the load of the bending portion, in one (basal) side, which extends continuously from the fulcrum portion 10*b* at an inclination angle in a cantilevered manner so as to be elastically deformable in the thickness direction of the hoop material 12, and which is formed into an L-like section shape, and a contacting portion 10*d* which is to be in contact with the metal cover 7 is formed in the other side (free-end side) of the plate spring piece portion 10*c*.

In each of the attaching portions 11*a* of the card contacting contacts 11, a first plate spring piece portion 110, a second plate spring piece portion 11*e*, and a contacting portion 11*f* are formed. In the first plate spring piece portion 11*c*, the other end side extends to between the contacting portions 10*d* of the shield contacts 10, and a bending portion is formed on the tip end side. The first plate spring piece portion has a first fulcrum portion 11*b* which supports the load of the bending portion, in one (basal) side, and is formed into a shape which continuously extends in a cantilevered manner from the first fulcrum portion 11*b* to the attaching portion 11*a* while forming a step, so as to be elastically deformable in the thickness direction of the hoop material 12. The second plate spring piece portion 11*e* is formed by partly cutting and raising the first plate spring piece portion 11*c*, has in one (basal) side a second fulcrum portion 11*d* which supports the load of a bending portion formed in the other end side (free-end side) of the first plate spring piece portion 11*c*, and is formed into a substantially L-like section shape which continuously extends in a cantilevered manner from the second fulcrum portion 11*d* at an inclination angle in the direction opposite to that of the first plate spring piece portion 11*e*, so as to be elastically deformable in the thickness direction of the hoop material 12. The contacting portion 11*f* is formed in the other end side (free-end side) of the second plate spring piece portion 11*e*, and in contact with the corresponding contact pad 2 of the small card 1.

Next, the attaching portions 10*a*, 11*a* of the two shield contacts 10 and nine card contacting contacts 11 (contact group) which are formed by a punching process in the hoop material (carrier) 12 in the state where the contacts are integrally coupled with one another are integrally molded by an insulating synthetic resin by means of insert molding, so that the contacts are integrated with the insulator 9 molded by the mold resin.

The insulator 9 is formed into a substantially rectangular plate-like shape so as to be fitted to the insulator attaching portion 5*e* of the lower case 5, and comprises: a front end portion 9*a* configured by a flat face which is positioned on the side of a rear end portion (the side of a front end portion of the insulator attaching portion 5*e*) of the external-connection terminal attaching portion 5*d* of the lower case 5; and a stepped rear end portion having both end portions 9*b*, 9*c* of the rear end portion, which are positioned respectively in front end sides of the contact attaching portions 5*j*, 5*m* of the lower case 5, and a middle portion 9*d* of the rear end portion, which is rearward projected from between the both end portions 9*b*, 9*c* of the rear end portion, and which is positioned between the stopper portions 5*h*, 5*k* of the lower case 5. The engaging groove 9*e* into which the engaging piece 7*f* of the front end portion of the metal cover 7 is to be fitted is formed in the upper face of the rear end portion on the side of the middle portion 9*d*. In a mold portion, plural vertically penetrating holes 9*f* through which the connecting portions 12*a* of the shield contacts 10 and the card contacting contacts 11 are exposed from the upper and lower faces of the insulator 9, respectively are formed.

In the two shield contacts 10 and nine card contacting contacts 11 (contact group) which are insert-molded in the state where they are integrally coupled to the hoop material (carrier) 12, next, a tool is passed through each of the holes 9*f* of the insulator 9 by a punching process to cut off the connecting portions 12*a* of the shield contacts 10 and the card contacting contacts 11, so that the two shield contacts 10 and nine card contacting contacts 11 which are integrally coupled together are individually separated. At the same time, the connecting portions 12*b* which project from the right and left side edge portions of the insulator 9, and which are coupled to the hoop material (carrier) 12 are cut off so as to be separated also from the hoop material (carrier) 12. As a result, as shown in FIGS. 5, 8, and 9, an electrical connecting component having the contact group disposed in the card adaptor 3 of the embodiment, i.e., the two shield contacts 10 and nine card contacting contacts 11 which are held integrally by the insulator 9 made of the insulative synthetic resin is completed.

In the two shield contacts 10 and nine card contacting contacts 11 which are held integrally by the insulator 9, the attaching portions 10*a*, 11*a* are embedded in the insulator 9, and the external connection terminals 4*f* are forward projected in parallel by the same length from the side face of the front end portion 9*a* of the insulator 9. The fulcrum portions 10*b* of the shield contacts 10, and the plate spring piece portions 10*c* and contacting portions 10*d* which precede the fulcrum portions are rearward projected in parallel from the side faces of the both end portions 9*b*, 9*c* of the rear end portion of the insulator 9. The first fulcrum portions 11*b* of the card contacting contacts 11, and the first plate spring piece portions 11*c*, second fulcrum portions 11*d*, second plate spring piece portions 11*e*, and contacting portions 11*f* which precede the fulcrum portions are rearward projected in parallel from the side face of the middle portion 9*d* of the rear end portion of the insulator 9.

During the assembly of the card adaptor 3 of the embodiment, as shown in FIG. 5, the insulator 9 is attached to the insulator attaching portion 5*e* of the lower case 5, thereby allowing the insulator 9 (the attaching portions 10*a*, 11*a* of the shield contacts 10 and the card contacting contacts 11) to be positioned and supported by the insulator attaching portion 5*e*. Furthermore, the external connection terminals 4*f* of the shield contacts 10 and card contacting contacts 11 which are forward projected in parallel from the side face of the front end portion 9*a* of the insulator 9 that functions as the side face on the side of the rear end portion of the external-connection terminal attaching portion 5*d* are positioned and supported above the respective external-connection terminal exposing holes 5*g* by the external-connection terminal attaching portion 5*d*. Moreover, the fulcrum portions 10*b* of the shield contacts 10 which are rearward projected in parallel from the side faces of the both end portions 9*b*, 9*c* of the rear end portion of the insulator 9, and the plate spring piece portions 10*c* and contacting portions 10*d* which precede the fulcrum portions are housed and placed in the contact attaching portions 5*j*, 5*m*. The first fulcrum portions 11*b* of the card contacting contacts 11 which are rearward projected in parallel from the side face on the side of the middle portion 9*d* of the rear end portion of the insulator 9 that functions as the side face of the front end portion side (inner side) of the card insertion space 5*f*, and the first plate spring piece portions 11*c*, second fulcrum portions 11*d*, second plate spring piece portions 11*e*, and contacting portions 11*f* which precede the fulcrum portions are housed and placed in the front end portion side (inner side) of the card insertion space 5*f*.

Figure 8:
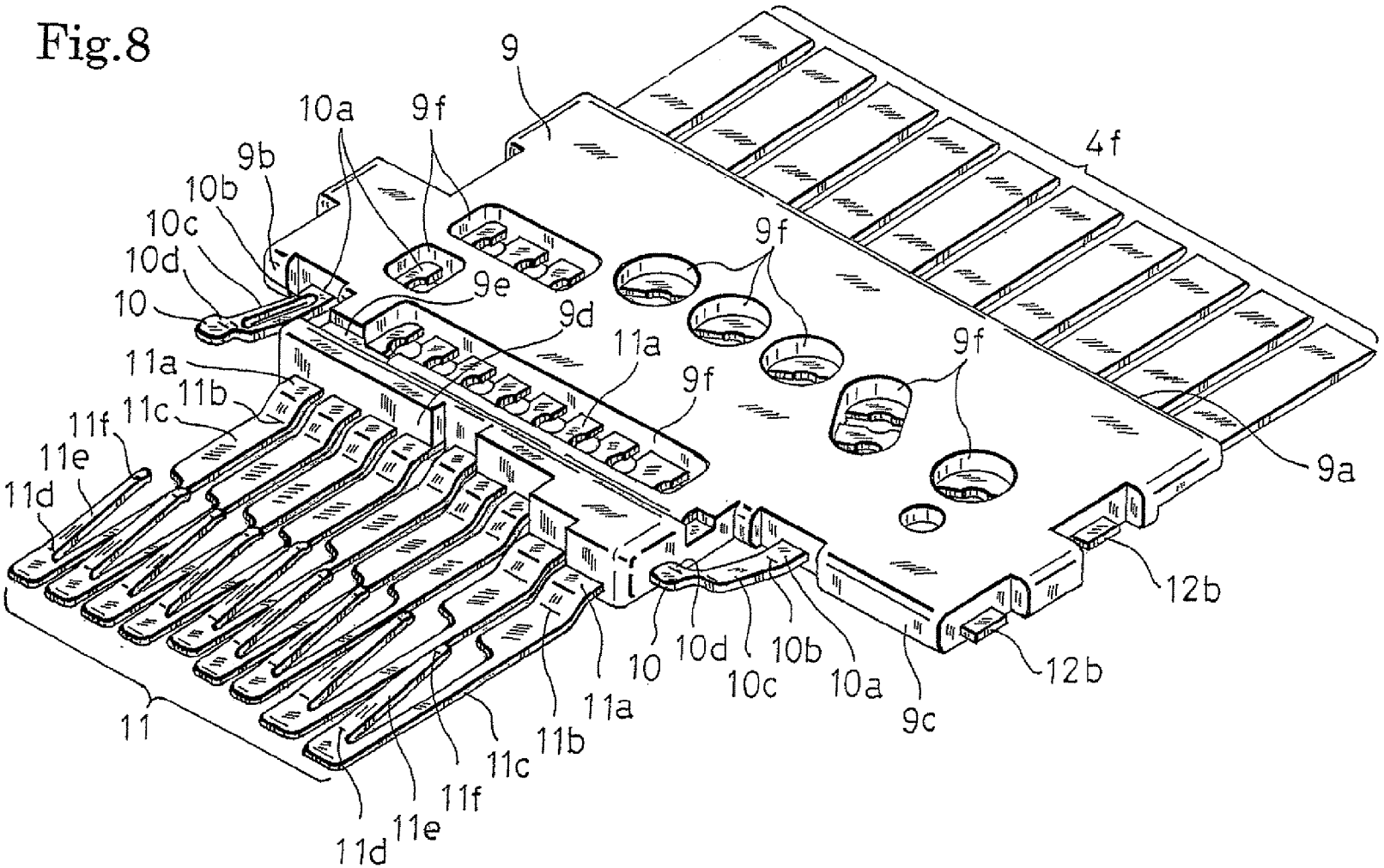
FIG. 8 is a perspective view showing the appearance of a contact group disposed in the card adaptor.

In the final stage of the assembly of the card adaptor 3 of the embodiment, as shown in FIGS. 8 and 9, the upper case of the two-piece structure configured by the resin cover 6 and the metal cover 7 is fixed to the upper portion of the lower case 5 to form the adaptor body 4, whereby the upper portions of the insulator 9 and the external connection terminals 4*f* of the shield contacts 10 and the card contacting contacts 11 are pressed by the resin cover 6 to be fixed into the adaptor body 4. The contacting portion 10*d* of the left shield contact 10 in FIG. 5 is pressed by the fixing piece 7*a* of the metal cover 7 to be in contact therewith, and the contacting portion 10*d* of the right shield contact 10 in FIG. 5 is pressed by the metal cover 7 to be in contact therewith, so that the shield contacts 10 cause the metal cover 7 to be always conductively connected to the external connection terminals 4*f* at the both ends.

Figure 11:
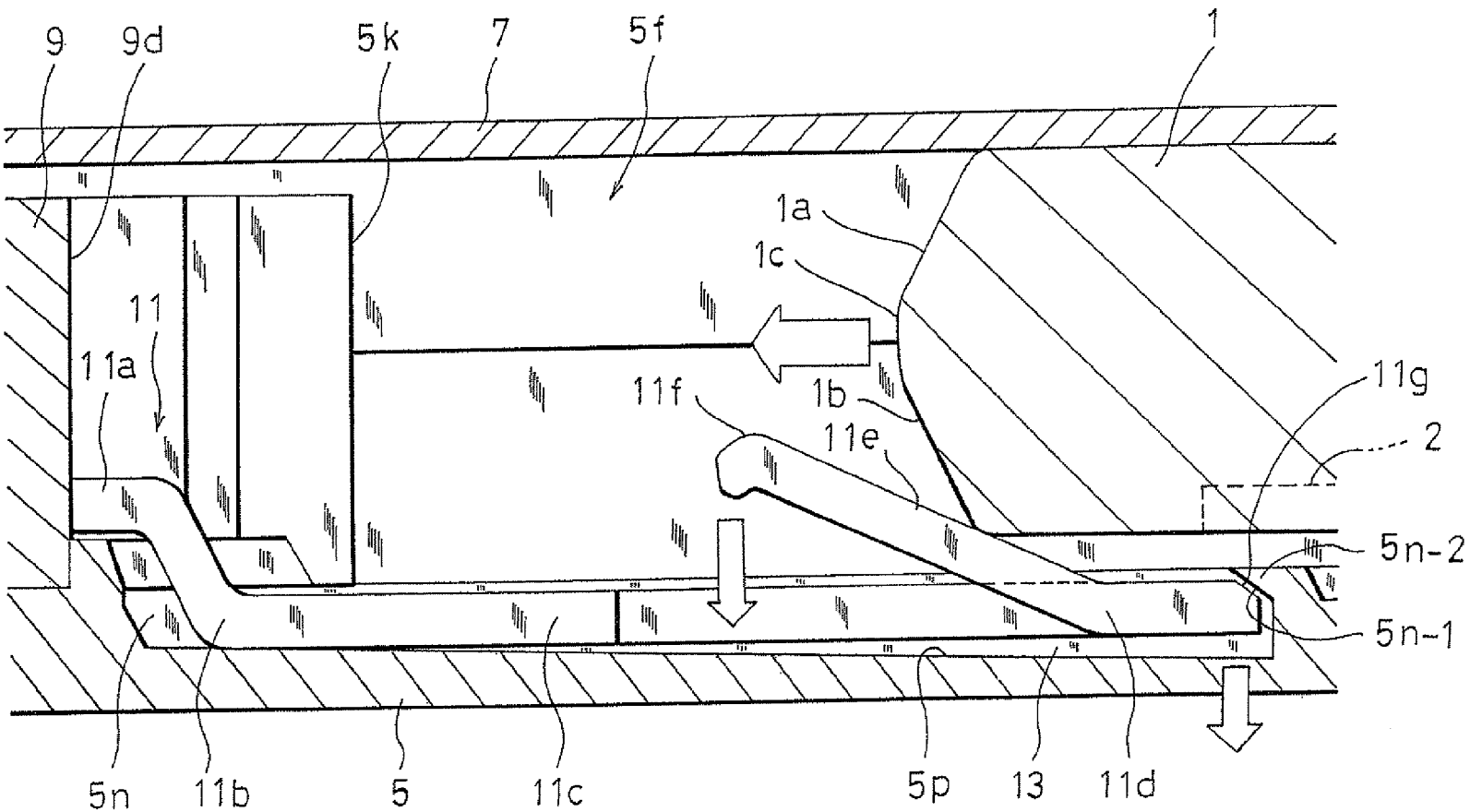
FIG. 11 is a partial enlarged section view showing a state where a contact contacting portion disposed in the card adaptor has not yet been displaced.
Figure 12:
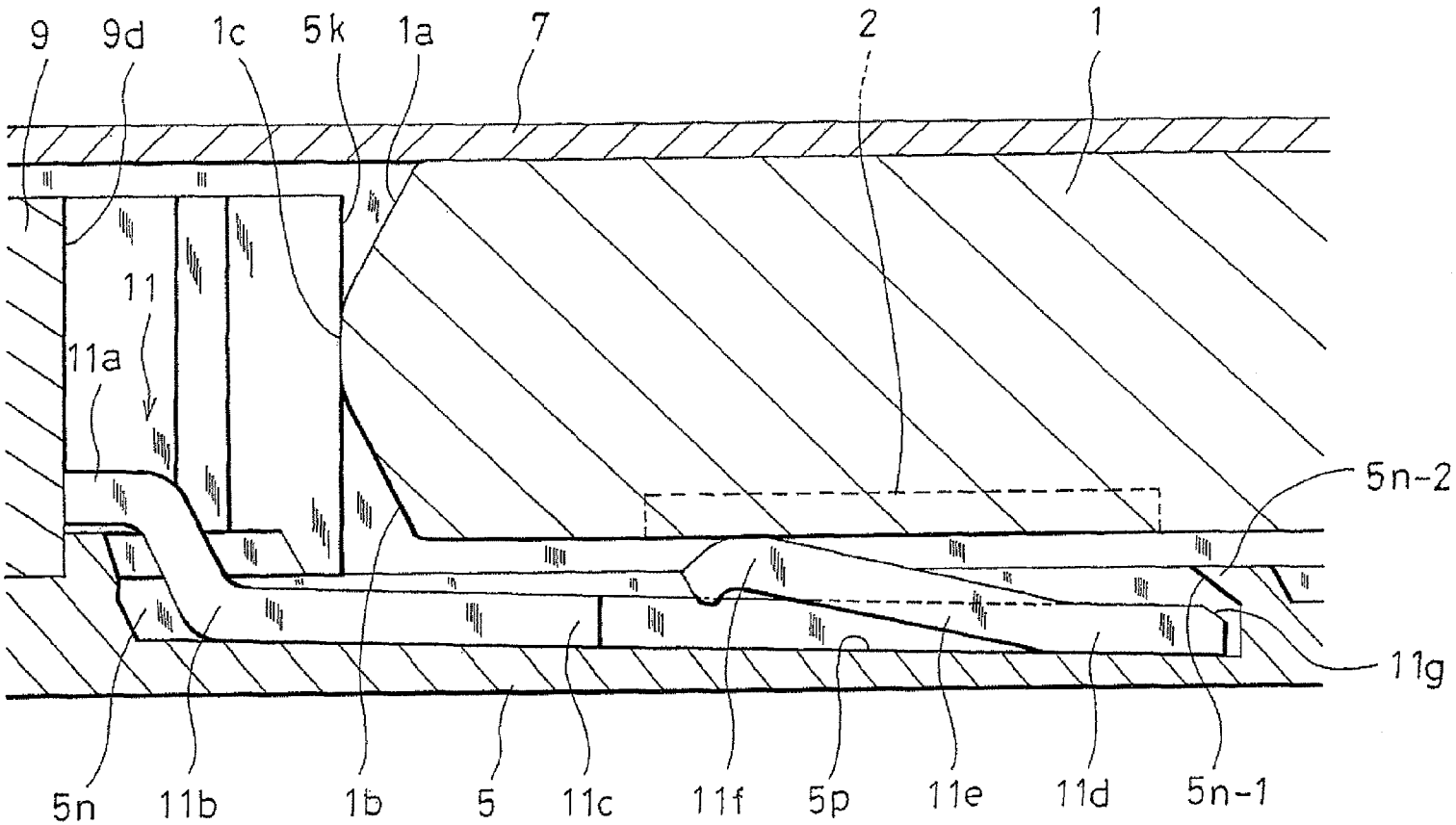
FIG. 12 is a partial enlarged section view showing a state where the contact contacting portion disposed in the card adaptor has been displaced.

In each of the plural contact housing grooves 5*n* which are juxtaposed on the side of the front end portion (inner side) of the bottom face of the card insertion space 5*f*, as shown in FIGS. 11 and 12, a bottom face 5*p* in which the depth is inclined so as to be gradually deeper as more advancing from the front end portion side toward the rear end portion side is disposed. Each of the first plate spring piece portions 11*c* of the card contacting contacts 11 is lowered by the bending portion forming the first fulcrum portion 11*b* disposed in the one (basal) side, from the side face on the side of the middle portion 9*d* of the rear end portion of the insulator 9 to the corresponding contact housing groove 5*n*, and, in a state where the first fulcrum portion 11*b* butts against the front end portion of the bottom face 5*p* of the contact housing groove 5*n*, extends substantially horizontally in a cantilevered manner, continuously from the front end portion of the contact housing groove 5*n* toward the rear end portion side. This causes the first plate spring piece portion 11*c* preceding the first fulcrum portion 11*b* to gradually separate from the bottom face 5*p* of the contact housing groove 5*n*, whereby a gap 13 which is gradually increased as more advancing toward the other end side (free-end side) of the first plate spring piece portion 11*c* is formed between the first plate spring piece portion 11*c* preceding the first fulcrum portion 11*b* and the bottom face 5*p* of the contact housing groove 5*n*. Namely, the first plate spring piece portions 11*c* of the card contacting contacts 11 are placed in the plural contact housing grooves 5*n* which are juxtaposed on the side of the front end portion (inner side) of the bottom face of the card insertion space 5*f*, so as to be elastically deformable vertically (in the thickness direction of the small card 1) with using the first fulcrum portions 11*b* disposed in the one side as a fulcrum, and extend continuously and substantially horizontally in a cantilevered manner from the first fulcrum portions 11*b* in the direction opposite to the card insertion direction. Although the first plate spring piece portions 11*c* of the card contacting contacts 11 are of the opposed type which is formed into a simple cantilevered shape where the first plate spring piece portions continuously extend from the first fulcrum portions 11*b* in the one side in the direction opposite to the card insertion direction, therefore, there is no possibility that buckling is caused by insertion of the small card 1 into the card insertion space 5*f*.

In the first plate spring piece portion 110 of each of the card contacting contacts 11, an edge portion of the upper side of the free end is chamfered to form a tapered portion 11*g*. In an upper portion of the groove wall of the rear end portion of each of the contact housing grooves 5*n*, a pressing portion 5*n*-2 which prevents the contact from rising, and under which a tapered portion 5*n*-1 opposed to the tapered portion 11*g* of the first plate spring piece portion 11*c* is disposed is formed projectingly toward the front end portion of the contact housing groove 5*n*, and the rear end portion of the contact housing groove 5*n* is formed into a pouch-like shape. According to the configuration, the free-end portion of the first plate spring piece portion 110 of each of the card contacting contacts 11 is housed in the pouch-like portion of the rear end portion of the contact housing groove 5*n*, and the rising toward the card insertion space 5*f* is prevented from occurring by the pressing portion 5*n*-2, while dispersions in the production of the card contacting contacts 11 are absorbed. Therefore, a butt contact with the front end portion 1*c* of the small card 1 which is inserted into the card insertion space 5*f* does not occur. Namely, a structure is formed where, in the first plate spring piece portion 11*c* of each of the card contacting contacts 11, the possibility that buckling is caused by insertion of the small card 1 into the card insertion space 5*f* is eliminated more surely.

The second plate spring piece portions 11*e* of the card contacting contacts 11 have the other end side of the first plate spring piece portion 11*c* which is positioned on the side of the rear end portion of the contact housing groove 5*n*, as the second fulcrum portion 11*d* on one side, extend continuously in a diagonally forward upward direction from the second fulcrum portion 11*d* in a cantilevered manner, and are projectingly placed in parallel on the side of the front end portion (inner side) of the card insertion space 5*f* in an inclined state where the front is higher and the rear is lower, so as to be elastically deformable vertically (in the thickness direction of the small card 1) with using the second fulcrum portions 11*d* as a fulcrum, thereby causing the contacting portion 11*f* disposed on the other side (free-end side) to be contacted with the corresponding contact pad 2 of the small card 1 inserted into the card insertion space 5*f*. Therefore, each of the second plate spring piece portions 11*e* which are placed in the card insertion space 5*f*, and which are to be contacted with the contact pads 2 of the small card 1 inserted into the card insertion space 5*f* is configured as the unopposed type in which the portion continuously extends at an inclination angle in a cantilevered manner from the second fulcrum portion 11*d* disposed in one side, in the card insertion direction (forward direction). Therefore, there is no possibility that buckling is caused by insertion of the small card 1 into the card insertion space 5*f*.

Figure 7:
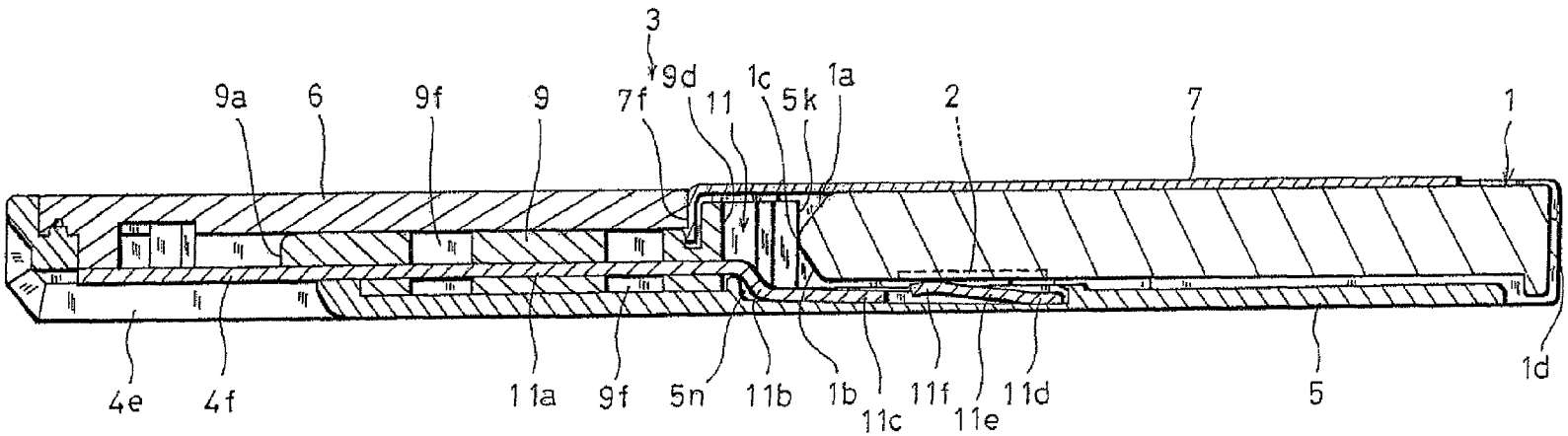
FIG. 7 is a section view showing an internal structure of a card attachment state of the card adaptor.

When the small card 1 is to be attached to the thus configured card adaptor 3 of the embodiment, the small card 1 is normally inserted from the front end portion 1*c* into the card insertion space 5*f* through the card insertion port 4*g* of the adaptor body 4 in a state where the rear face (one principal face) of the small card 1 where the contact pads 2 are juxtaposed is positioned on the side of the lower case 5 of the adaptor body 4. The engaging portion 8*a* of the lock spring 8 which is attached to the lock-spring attaching portion 5*q* is projected in one side edge portion of the card insertion space 5*f*. Therefore, the small card outward presses the engaging portion 8*a* of the lock spring 8 with the side edge portion on the side of the step portion 1*f* in which the recess 1*i* is formed, and, in a state where, while flexurally deforming the lock spring 8 toward the outside, the engaging portion 8*a* is retracted in the lock-spring attaching portion 5*q*, the small card is inserted toward the front end portion side (inner side) of the card insertion space 5*f*. When the small card 1 is further inserted, the front end portion 1*c* of the small card 1 butts against the stopper portions 5*h*, 5*k* formed in the lower case 5 of the adaptor body 4. At this timing, the insertion of the small card 1 is restricted, the engaging portion 8*a* of the lock spring 8 is opposed to the recess 1*i* of the small card 1, and the engaging portion 8*a* is returned by the elastic force of the lock spring 8 to be engaged with the recess 1*i* of the small card 1. As a result, as shown in FIGS. 2, 3, and 7, the small card 1 is completely inserted into the card insertion space 5*f* of the adaptor body 4, and accidental drop-off of the small card 1 is prevented by the lock spring 8 from occurring.

When the small card 1 is normally inserted into the card insertion space 5*f* of the adaptor body 4, the first plate spring piece portions 11*c* of the card contacting contacts 11 extend continuously and substantially horizontally in a cantilevered manner from the first fulcrum portions 11*b* in the direction opposite to the card insertion direction, in the plural contact housing grooves 5*n* which are juxtaposed on the side of the front end portion (inner side) of the bottom face of the card insertion space 5*f*, in the state where the first fulcrum portions 11*b* disposed in the one (basal) side butt against the front end portions of the bottom faces 5*p* of the contact housing grooves 5*n*, and the gaps 13 which are gradually increased as more advancing toward the other end sides (free-end sides) of the first plate spring piece portions 11*c* are formed between the first plate spring piece portions 11*c* preceding the first fulcrum portions 11*b* and the bottom faces 5*p* of the contact housing grooves 5*n*. Furthermore, the second plate spring piece portions 11*e* having the other end sides of the first plate spring piece portions 11*e* which are positioned on the side of the rear end portions of the contact housing grooves 5*n*, as the second fulcrum portions 11*d* on one side extend continuously in a diagonally forward upward direction from the second fulcrum portions 11*d* in a cantilevered manner, and are projectingly placed in parallel on the side of the front end portion (inner side) of the card insertion space 5*f* in an inclined state where the front is higher and the rear is lower. As shown in FIG. 11, therefore, the lower side of the front end portion 1*c* of the small card 1 is contacted with the inclined surfaces of the second plate spring piece portions 11*e* of the card contacting contacts 11, and then the small card 1 slides to press down the second plate spring piece portions. Therefore, the first plate spring piece portions 11*e* of the card contacting contacts 11 are downward flexurally deformed with setting the first fulcrum portions 11*b* butting against the front end portions of the bottom faces 5*p* of the contact housing grooves 5*n*, as fulcrums, and butt against the bottom faces 5*p* of the contact housing grooves 5*n*. Then, the second plate spring piece portions 11*e* of the card contacting contacts 11 are downward flexurally deformed with setting the second fulcrum portions 11*d* butting against the rear end portions of the bottom faces 5*p* of the contact housing grooves 5*n*, as fulcrums. When the small card 1 is further inserted, as shown in FIG. 12, the lower side of the front end portion 1*c* of the small card 1 passes over the contacting portions 11*f* of the card contacting contacts 11, the small card 1 overrides the flexurally deformed first and second plate spring piece portions 11*c*, 11*e* of the card contacting contacts 11, and the contacting portions 11*f* of the card contacting contacts 11 are pressed and contacted from the lower side against the contact pads 2 juxtaposed on the rear face (one principal face) of the small card 1, by the elastic forces of the first and second plate spring piece portions 11*c*, 11*e*. As a result, the contact pads 2 of the small card 1 which is completely inserted into the card insertion space 5*f* of the adaptor body 4 are conductively connected to the corresponding external connection terminals 4*f* through the card contacting contacts 11. When the small card 1 is pulled out from the card insertion space 5*f* of the adaptor body 4 and the pressing-down by the small card 1 is canceled, the second plate spring piece portions 11*e* are returned to their original shapes by their elastic forces with using the second fulcrum portions 11*d* as fulcrums, and then the first plate spring piece portions 11*c* are returned to their original shapes, so that the first and second plate spring piece portions 11*c*, 11*e* of the card contacting contacts 11 are returned to the free state shown in FIG. 11.

When the card adaptor 3 of the embodiment to which the small card 1 is attached as described above is normally inserted and attached into a card connector corresponding to the large card, the external connection terminals 4*f* of the adaptor body 4 are contacted with plural contacts juxtaposed in a card insertion space of the card connector, respectively, so that the small card 1 is electrically connected to an electronic apparatus corresponding to the large card (an electronic apparatus in which the card connector corresponding to the large card is mounted on a printed circuit board) such as a portable telephone, to allow signals to be transmitted between the small card and the electronic apparatus. As a result, the small card 1 can be used in the electronic apparatus corresponding to the large card.

As seen from the above, the card adaptor 3 of the embodiment comprises the card contacting contacts 11 each of which is to be placed in the card insertion space 5*f* and contacted with the contact pad 2 which is disposed on one principal face of the card 1, wherein the first plate spring piece portion 11*c* having the first fulcrum portion 11*b* in one side extends in a cantilevered manner from the first fulcrum portion 11*b* in the direction opposite to the card insertion direction so as to be elastically deformable in the thickness direction of the card, the second plate spring piece portion 11*e* having in one side the second fulcrum portion 11*d* which is the other side of the first plate spring piece portion 11*c* is formed in a shape where the second plate spring piece portion extends at an inclination angle in a cantilevered manner from the second fulcrum portion 11*d* in the card insertion direction so as to be elastically deformable in the card thickness direction, and the other side of the second plate spring piece portion 11*e* is to be contacted with the contact pad 2 of the card 1. Furthermore, the case members 5, 6, 7 which form the card insertion space 5*f* constitute the adaptor body 4 having the external shape for the other card which is larger than the card 1 that is to be inserted into the card insertion space 5*f*.

Figure 18:
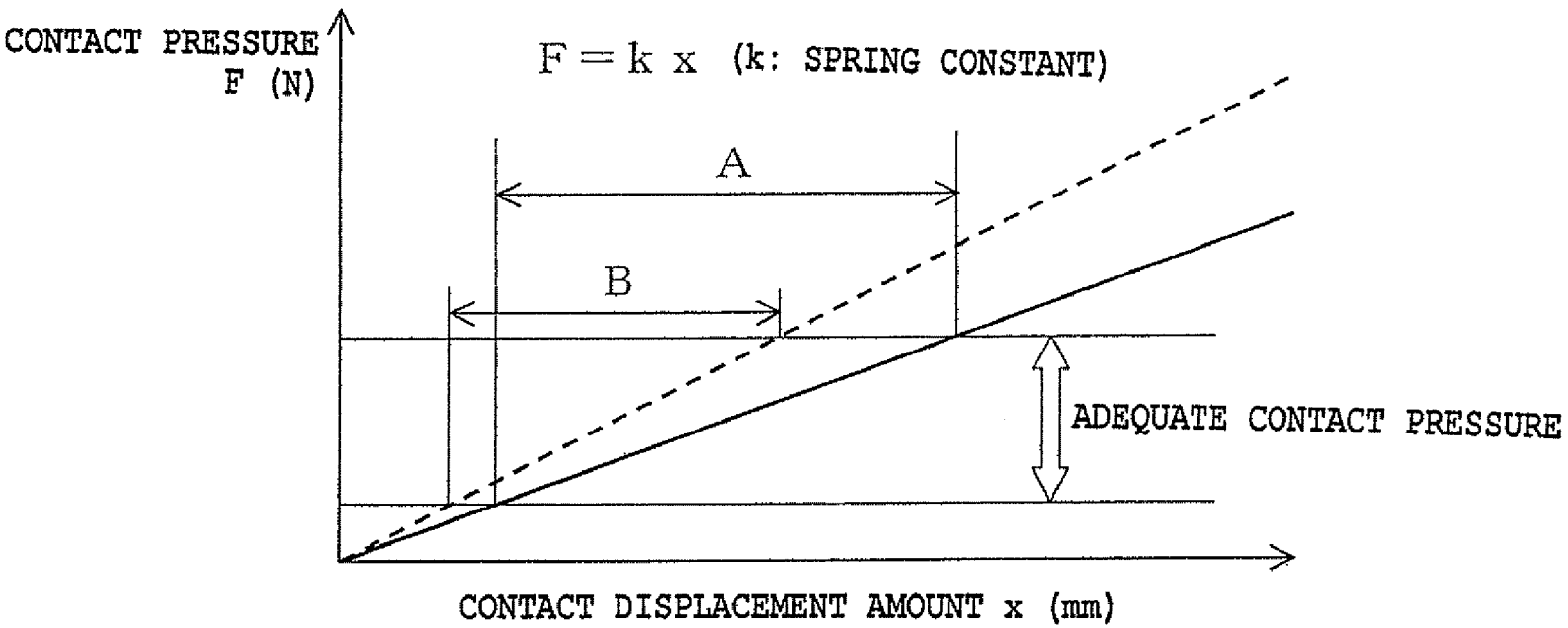
FIG. 18 is a graph showing the relationship of a contact pressure F (N) of a contact and a displacement amount x (mm).

When each of the card contacting contacts 11 is formed into the above-described shape, the plate spring piece portion (second plate spring piece portion 11*e*) which is to be contacted with the contact pad 2 of the card 1 is configured as the unopposed type in which the portion extends at an inclination angle in a cantilevered manner from the fulcrum portion (second fulcrum portion 11*d*) in the card insertion direction (forward direction). Therefore, the possibility that buckling is caused by insertion of the card 1 can be eliminated, and the contact pressure can be increased or decreased in accordance with increase or decrease of the displacement amount of the contact 11. Consequently, a sufficient contact pressure can be ensured even when the spring constant of the contact 11 is not increased, the range of a displacement amount where an adequate contact pressure can be obtained is not narrowed (see FIG. 18), and it is not required to strictly manage the position of the contacting portion 11*f* to suppress dispersions. As a result, a stable contact pressure of the contact 11 can be easily ensured. Structurally, a stress can be dispersed to two portions (the first fulcrum portion 11*b* of the first plate spring piece portion 11*c* and the second fulcrum portion 11*d* of the second plate spring piece portion 11*e*), and in addition a generated stress can be suppressed to a low level by not increasing the spring constant. This stress relaxation can prolong the life period of the contact 11. Therefore, a long life period of the contact 11 can be easily ensured.

The second plate spring piece portion 11*e* may be formed in a shape where it is folded back from the other side of the first plate spring piece portion 11*c*. Alternatively, the second plate spring piece portion 11*e* may be formed by partly cutting and raising the first plate spring piece portion 11*c*, thereby allowing the second plate spring piece portion 11*e* to directly extend at an inclination angle in a cantilevered manner from the other side of the first plate spring piece portion 11*c* in the card insertion direction (forward direction), without passing through a folded back portion (radius of curvature). Therefore, a larger displacement amount of the contact 11 can be obtained, and a stable contact pressure of the contact 11 can be ensured more easily.

According to the card adaptor 3 of the embodiment, therefore, a stable contact pressure and a long life period can be easily ensured in the contact 11 for card contact disposed in the card adaptor.

In the card adaptor 3 of the embodiment, the two external connection terminals 4*f* (the two shield contacts 10 and the right-end card contacting contact 11 in FIG. 5) in the right and left ends in FIG. 5 are used for grounding, and the two external connection terminals 4*f* are individually separated. Alternatively, the two external connection terminals 4*f* may be continuously integrally molded to be conductively connected (short-circuited) to each other, or conductively connected (short-circuited) to each other by using a conductive member which is configured as a separate component.

Next, an embodiment of the contact of the invention and the card connector having it will be described with reference to FIGS. 13 to 17. In the embodiment, the case where the invention is applied to a card connector corresponding to a memory card of a certain standard, such as a micro SD card (hereinafter, referred to as "third card") will be described.

Figure 13A:
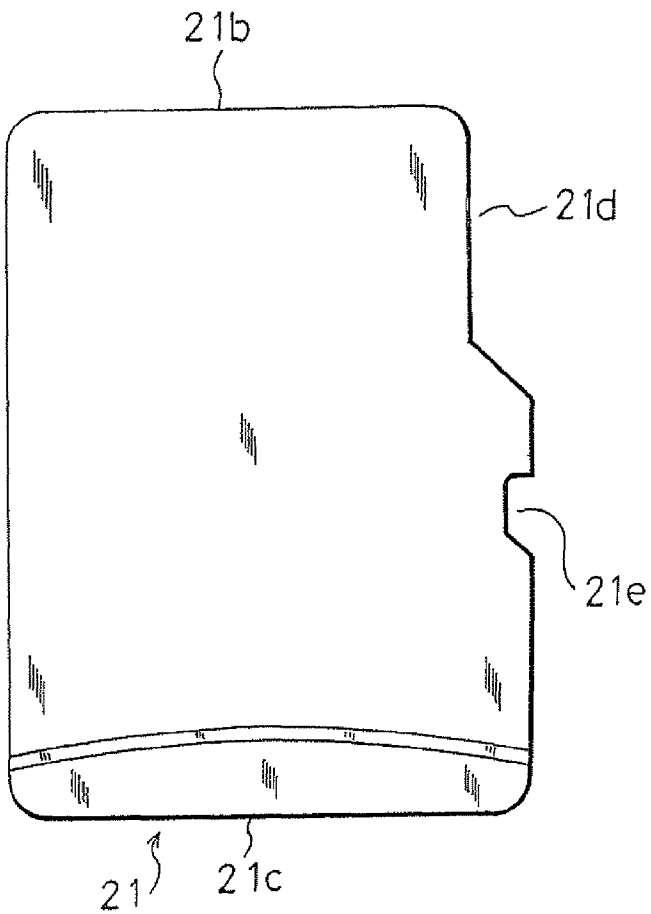
FIG. 13A is a front view showing a card to be used with a card connector of the embodiment of the invention.
Figure 13B:
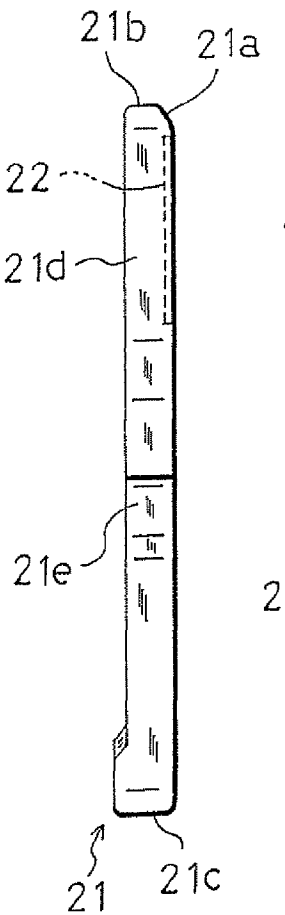
FIG. 13B is a side view.
Figure 13C:
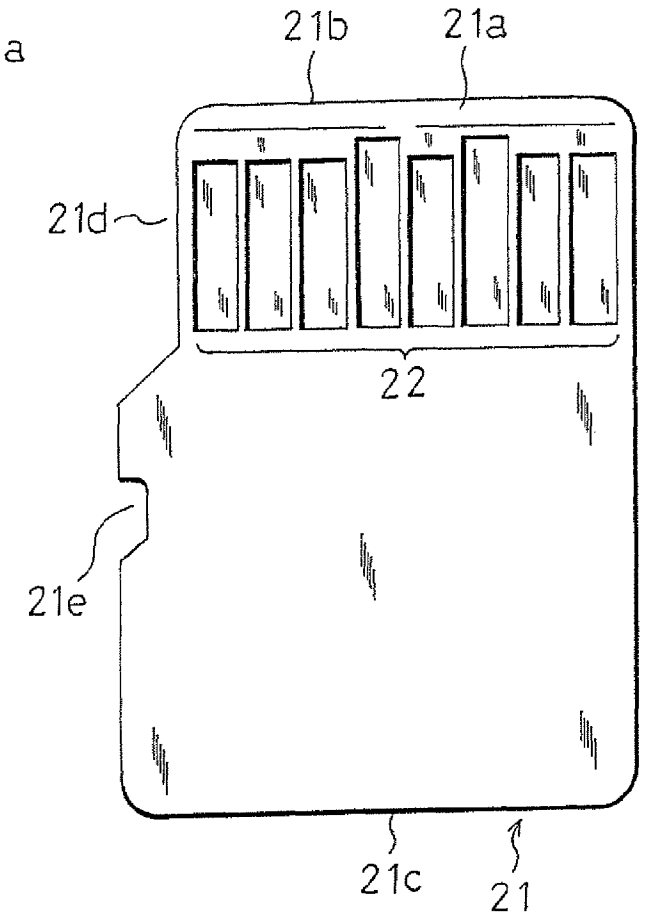
FIG. 13C is a rear view.

As shown in FIG. 13, the third card 21 comprises: a front end portion 21*b* which, when the third card 21 is inserted into a card adaptor for connecting with a card connector corresponding to a larger card or the card connector of the embodiment, is positioned in the front side, and which has a tapered portion 21*a* in the lower portion; and a rear end portion 21*c* which is positioned in the rear side, and which is configured by a flat face. A cutaway portion 21*d* for preventing erroneous insertion in an inverted front and rear or surface and rear face relationship into a card adaptor for connecting the third card 21 with a card connector corresponding to a larger card or the card connector of the embodiment, from occurring is disposed on the side of the front end portion 21*b* of a right side edge portion in FIG. 13A. A cutaway portion 21*e* for, when the third card 21 is inserted into a card adaptor for connecting with a card connector corresponding to a larger card or the card connector of the embodiment, holding the third card 21 to an attachment position of the card adaptor or the card connector is formed on the side of the rear end portion 21*c* with respect to the cutaway portion 21*d* for preventing erroneous insertion. Plural (eight) contact pads 22 for external connection are juxtaposedly arranged on the rear face (one principal face) on the side of the front end portion 21*d*.

Figure 14:
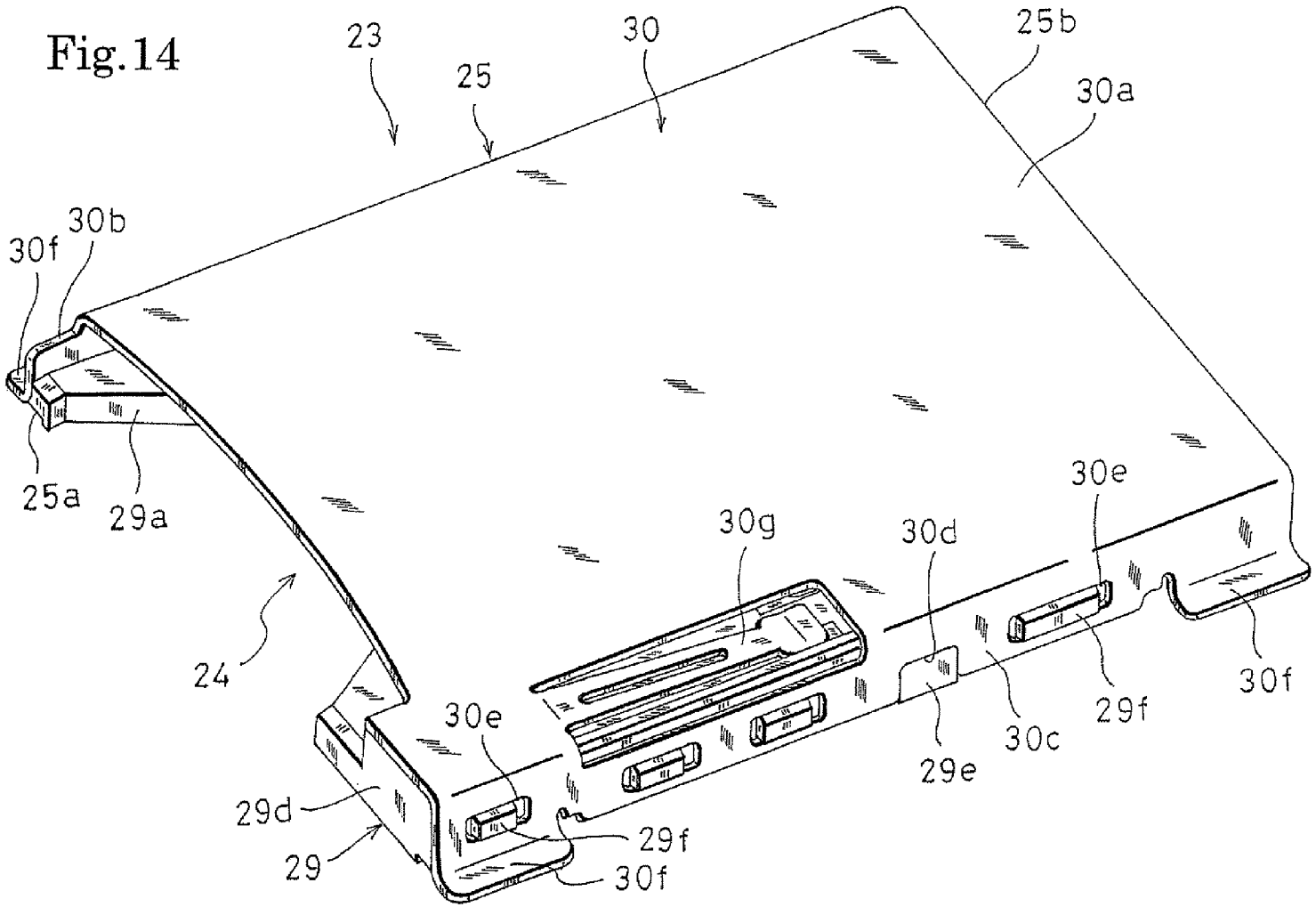
FIG. 14 is a perspective view showing the appearance of the card connector.
Figure 15:
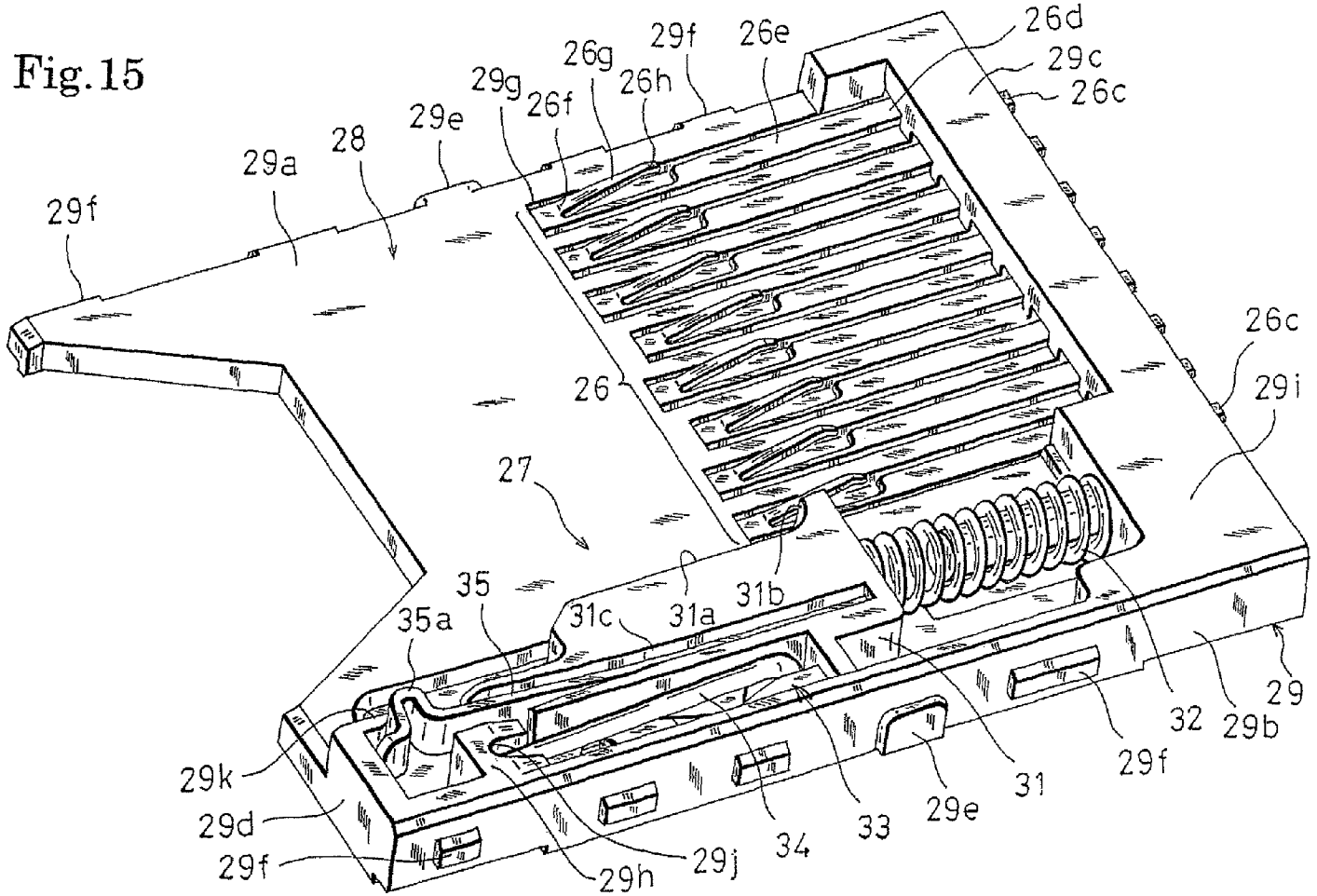
FIG. 15 is a section view showing the internal structure of the card connector.

As shown in FIGS. 14 and 15, the card connector 23 of the embodiment is configured by: a connector housing 25 comprising a front end portion 25*a* positioned in a card insertion port disposed in a case of an electronic apparatus, and a rear end portion 25*b* opposite to the portion, and having a box-like shape where a card insertion port 24 through which the third card 21 is inserted from the front end portion 21*b* while downward directing the rear face on which the contact pads 22 are juxtaposed opens in a side face on the side of the front end portion 25*a*; plural (eight) card contacting contacts 26 of the invention which are incorporated in the connector housing 25, and which are contacted with the contact pads 22 of the third card 21, respectively, so that the card is electrically connected to a printed circuit board of the electronic apparatus; a card recognition switch (not shown) which is incorporated in the connector housing 25, and which is formed by a pair of metal pieces for electrically detecting attachment of the third card 21 on the side of the electronic apparatus; and a push/push type card extraction mechanism 27 which is incorporated in the connector housing 25, and in which the third card 21 is held and attached to a predetermined position in the connector housing 25 by a first pushing operation performed on the third card 21, and the third card 21 attached to the connector housing 25 is extracted by a second pushing operation performed on the third card 21.

In the connector housing 25, the internal space on the inner side (front side) of the card insertion port 24 functions as a card insertion space 28 where the card contacting contacts 26 and the card recognition switch are placed, and the internal space on the right side of the card insertion space 28 functions as a space for placing the card extraction mechanism 27. The connector housing 25 is configured by: a lower case 29 to which conductive members such as the card contacting contacts 26 and the pair of metal pieces for the card recognition switch are attached, and which is made of an insulative synthetic resin; and an upper case 30 which is attached from the upper side to the lower case 29 to apply countermeasures against electrostatic breakdown and noise, and which is formed by punching and bending a metal plate.

The lower case 29 is formed by integrating a housing bottom wall 29*a*, a housing right side wall 29*b*, a housing rear side wall 29*c*, and a housing front wall 29*d* which is on the right side of the card insertion port 24. Positioning engaging portions 29*e* and plural fixation engaging portions 29*f* which are to coupled with the upper case 30 are projected in outer side directions from the left end face of the housing bottom wall 29*a* and the outer face of the housing right side wall 29*b*. In the bottom face of the card insertion space 28 opposed to the rear face of the third card 21 on which the contact pads 22 are juxtaposed, plural (eight) thin contact housing grooves 29*g* which correspond respectively to the card contacting contacts 26, and which extend in the anteroposterior direction (in the card insertion and extraction direction) are juxtaposed on the side of the front end portion (inner side). Front and rear stopper portions 29*h*, 29*i* which receive a slide member of the card extraction mechanism 27 are disposed in front and rear end portions of the space for placing the card extraction mechanism 27, respectively. A bearing portion 29*j* for supporting a cam pin of the card extraction mechanism 27 is disposed in the thickness of the front stopper portion 29*h*. A return-side stopper portion 29*k* which is engaged with an engaging portion of a lock spring of the card extraction mechanism 27 which is used for the third card 21 is disposed in an end portion of the housing front wall 29*d*.

In each of the contact housing grooves 29*g*, the rear end portion side is passed through the housing rear side wall 29*c*, and opens in the outer face, and a bottom face in which the depth is inclined so as to be gradually deeper as more advancing from the rear end portion side toward the front end portion side is disposed.

The upper case 30 is configured by integrally forming a housing top plate 30*a*, a housing left side wall 30*b*, and a housing right side wall cover 30*c* which covers the outer face of the housing right side wall 29*b* of the lower case 29. On the housing left side wall 30*b* and the housing right side wall cover 30*c*, positioning engaging recesses 30*d* into which the positioning engaging portions 29*e* of the lower case 29 are to be fitted, and plural fixation engaging holes 30*e* into which the fixation engaging portions 29*f* of the lower case 29 are to be fitted are disposed. On each of the housing left side wall 30*b* and the housing right side wall cover 30*c*, terminal portions 30*f* which are used for mounting the connector, and which are formed by bending front and rear end portions of the lower edge so as to be projected substantially horizontally toward the outer side are disposed. In the housing top plate 30*a*, a plate spring piece 30*g* which is provided with elasticity for always downward pressing the cam pin of the card extraction mechanism 27 is formed in a cantilevered manner by cutting and raising.

Figure 16:
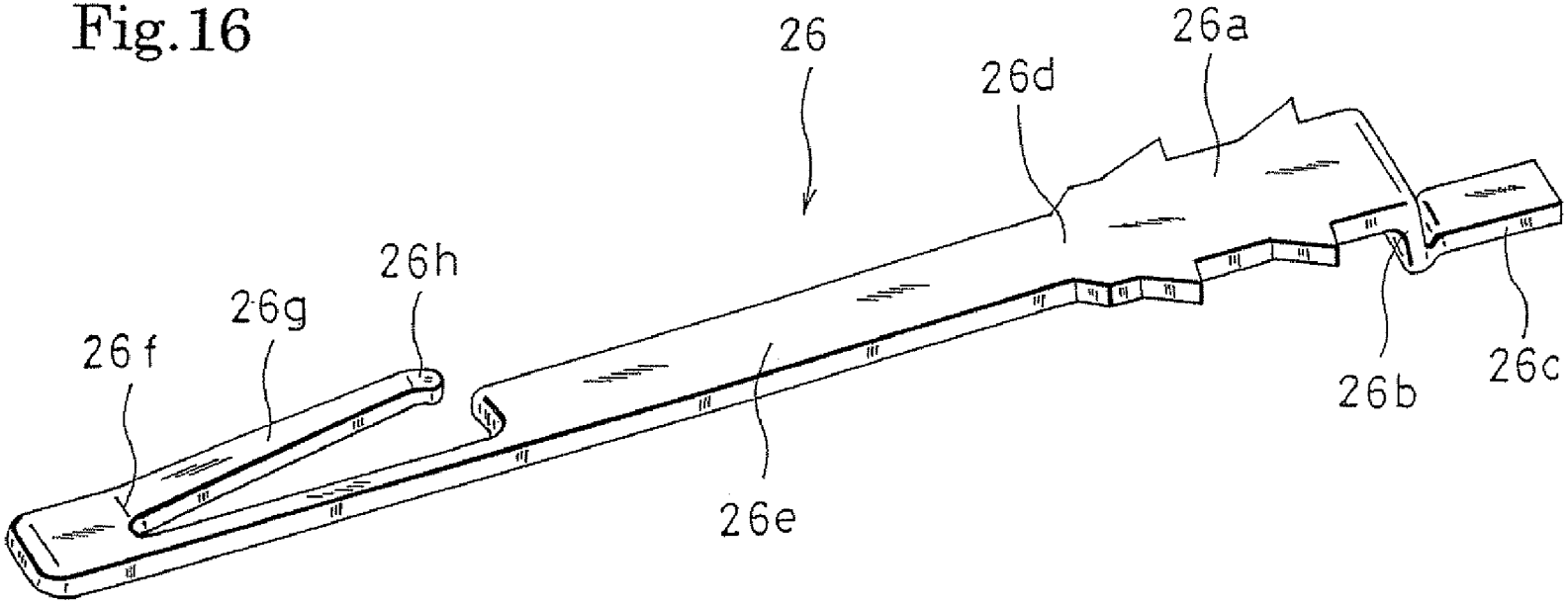
FIG. 16 is a perspective view showing the appearance of a contact disposed in the card connector.

The card contacting contacts 26 are molded in a state where they are integrally coupled to each other in a parallel manner by applying a punching process on a hoop material made of a spring material having superior electrical conductivity. In each of the card contacting contacts 26, as shown in FIG. 16, an attaching portion 26*a* for the lower case 29 is formed in the rear end portion side. In the attaching portion 26*a* of the card contacting contact 26, an external connection terminal 26*c* which extends substantially horizontally in a rearward direction is formed in a rear end portion side so as to be continuous from a position which is stepped down through a bent portion 26*b*. In the card contacting contact 26, furthermore, formed is a first plate spring piece portion 26*e* which has a first fulcrum portion 26*d* for supporting the load of the front end portion side of the attaching portion 26*a*, in one (basal) side, and which is formed into a shape which continuously forward extends in a cantilevered manner from the first fulcrum portion 26*d*, so as to be elastically deformable in the thickness direction of the hoop material. A second plate spring piece portion 26*g* is formed by partly cutting and raising the first plate spring piece portion 26*e*, has in one (basal) side a second fulcrum portion 26*f* which supports the load of a bending portion formed in the other end side (free-end side) of the first plate spring piece portion 26*e*, and is formed into a substantially L-like section shape which continuously extends at an inclination angle in a cantilevered manner from the second fulcrum portion 26*f* in the (rearward) direction opposite to that of the first plate spring piece portion 26*e*, so as to be elastically deformable in the thickness direction of the hoop material. A contacting portion 26*h* is formed in the other end side (free-end side) of the second plate spring piece portion 26*g*, and in contact with the corresponding contact pad 22 of the third card 21. In the molded state, the external connection terminals 26*c* of the card contacting contacts 26 are integrally coupled with one another by connecting portions, and the connecting portions are integrally coupled with the hoop material (carrier) by plural connecting pieces, so that the eight card contacting contacts 26 are integrally coupled with the hoop material in a parallel manner.

The eight card contacting contacts 26 (contact group) which are molded by a punching process on the hoop material (carrier) in the state where they are integrally coupled to one another as described above are separated from the hoop material (carrier) by cutting off the connecting pieces. The other ends (free end sides) of the first plate spring piece portions 26*e* of the card contacting contacts 26 are inserted from the rear side of the lower case 29 into the respective contact housing grooves 29*g*, and the attaching portions 26*a* of the card contacting contacts 26 are pressingly inserted and fixed to the housing rear side wall 290 of the case 29. Thereafter, the connecting portions are cut off, whereby the eight card contacting contacts 26 in a state where they are individually separated are attached to the lower case 29.

In the card contacting contacts 26 in the attachment state, as shown in FIG. 15, the external connection terminals 260 are lowered through the bent portions 26*b* to a lower portion of the lower case 29, and then rearward projected in parallel from the outer face of the housing rear side wall 29*c*.

In a state where the first fulcrum portion 26*d* disposed in one (basal) side butts against the rear end portion of the bottom face of the contact housing groove 29*g*, each of the first plate spring piece portions 26*e* of the card contacting contacts 26 extends substantially horizontally in a cantilevered manner, continuously from the rear end portion toward the front end portion side in the contact housing groove 29*g*. This causes the first plate spring piece portion 26*e* preceding the first fulcrum portion 26*d* to gradually separate from the bottom face of the contact housing groove 29*g*, whereby a gap which is gradually increased as more advancing toward the other end side (free-end side) of the first plate spring piece portion 26*e* is formed between the first plate spring piece portion 26*e* preceding the first fulcrum portion 26*d* and the bottom face of the contact housing groove 29*g*. Namely, the first plate spring piece portions 26*e* of the card contacting contacts are placed in the plural contact housing grooves 29*g* which are juxtaposed on the side of the rear end portion (inner side) of the bottom face of the card insertion space 28, so as to be elastically deformable vertically (in the thickness direction of the third card 21) with using the first fulcrum portions 26*d* disposed in the one side as a fulcrum, and extend substantially horizontally in a cantilevered manner from the first fulcrum portions 26*d* in the direction opposite to the card insertion direction. Although the first plate spring piece portions 26*e* of the card contacting contacts 26 are of the opposed type which is formed into a simple cantilevered shape where the first plate spring piece portions continuously extend from the first fulcrum portions 26*d* disposed in the one side in the direction opposite to the card insertion direction, therefore, there is no possibility that buckling is caused by insertion of the third card 21 into the card insertion space 28.

In the first plate spring piece portion 26*e* of each of the card contacting contacts 26, an edge portion of the upper side of the free end is chamfered to form a tapered portion. In an upper portion of the groove wall of the rear end portion of each of the contact housing grooves 29*g*, a pressing portion which prevents the contact from rising, and under which a tapered portion opposed to the tapered portion of the first plate spring piece portion 26*e* is disposed is formed projectingly toward the rear end portion of the contact housing groove 29*g*, and the front end portion of the contact housing groove 29*g* is formed into a pouch-like shape. According to the configuration, the free-end portion of the first plate spring piece portion 26*e* of each of the card contacting contacts 26 is housed in the pouch-like portion of the front end portion of the contact housing groove 29*g*, and the rising toward the card insertion space 28 is prevented from occurring by the pressing portion, while dispersions in the production of the card contacting contacts 26 are absorbed. Therefore, a butt contact with the front end portion 21*b* of the third card 21 which is inserted into the card insertion space 28 does not occur. Namely, a structure is formed where, in the first plate spring piece portion 26*e* of each of the card contacting contacts 26, the possibility that buckling is caused by insertion of the third card 21 into the card insertion space 28 is eliminated more surely.

The second plate spring piece portions 26*g* of the card contacting contacts 26 have the other end side of the first plate spring piece portion 26*e* which is positioned on the side of the front end portion of the contact housing groove 29*g*, as the second fulcrum portion 26*f* on one side, extend continuously in a diagonally rearward upward direction from the second fulcrum portion 26*f* in a cantilevered manner, and are projectingly placed in parallel on the side of the rear end portion (inner side) of the card insertion space 28 in an inclined state where the front is lower and the rear is higher, so as to be elastically deformable vertically (in the thickness direction of the third card 21) with using the second fulcrum portions 26*f* as a fulcrum, thereby causing the contacting portion 26*h* disposed on the other side (free-end side) to be contacted with the corresponding contact pad 22 of the third card 21 inserted into the card insertion space 28. Therefore, each of the second plate spring piece portions 26*g* which are placed in the card insertion space 28, and which are to be contacted with the contact pads 22 of the third card 21 inserted into the card insertion space 28 is configured as the unopposed type in which the portion continuously extends at an inclination angle in a cantilevered manner from the second fulcrum portion 26*f* disposed in one side in the card insertion direction (forward direction). Therefore, there is no possibility that buckling is caused by insertion of the third card 21 into the card insertion space 28.

As shown in FIG. 15, the push/push type card extraction mechanism 27 is configured by: a slide member 31; a coil spring 32 which is an urging member for the slide member 31; a position holding mechanism which is used for the slide member 31, and which is formed by a heart-shaped cam groove 33 and a cam pin 34; and a lock spring 35 which causes the third card 21 to be engaged with the slide member 31.

The slide member 31 is made of an insulative synthetic resin, and placed in the space for placing the card ejection mechanism 27 in the housing 25 so as to be reciprocable in the anteroposterior direction (in the card insertion and extraction direction) along the housing right side wall 29*b* between the front and rear stopper portions 29*h*, 29*i*. In the slide member 31, an overhang portion 31*a* which is projected to the left side of the card insertion space 28, and which, in the card insertion, is fitted into the erroneous insertion preventing cutaway portion 21*d* of the third card 21, an operating portion 31*b* which, in order that the slide member 31 is pushed toward the inner side by the third card 21, is projected from a rear portion of the overhang portion 31*a* into the card insertion space 28 so as to butt against the front end portion 21*b* of the third card 21, the heart-shaped cam groove 33 of the position holding mechanism, and a slit groove 31*c* for attaching the lock spring 35 are integrally formed.

The coil spring 32 is placed between the slide member 31 and the rear stopper portion 29*i*, and always urges the slide member 31 toward the front side (card extraction direction).

The cam pin 34 of the positioning mechanism is configured by a thin round metal bar which is bent in a U-like shape, and moved in the cam groove 33 in accordance with the movement of the slide member 31 while one end of the cam pin is substantially perpendicularly contacted with the bottom of the cam groove 33 formed in the slide member 31, and the other end is rotatably supported by the bearing portion 29*j* disposed in the lower case 29. The cam pin 34 is always downward pressed by the plate spring piece 30*g* disposed on the upper case 30, one end of the cam pin is substantially perpendicularly pressed against the cam groove 33, and the other end is pushed into the bearing portion 29*j*.

The lock spring 35 is configured by a metal plate spring. In one end portion of the spring, an engaging portion 35*a* which is formed by bending the metal plate spring into a mountain-like shape along the length direction is disposed. When the lock spring 35 is pressingly inserted from the upper side into the slit groove 31*c* of the slide member 31, one side of the lock spring 35 is fixed to the slide member 31 through the slit groove 31*c*, and the other side which forward extends from the fixed portion is projected to the front side of the slide member 31 so as to be elastically deformable in the lateral width direction of the card. The engaging portion 35*a* which is disposed in the other side of the lock spring 35 is projected on the front side of the overhang portion 31*a* of the slide member 31 so as to be elastically deformable in the lateral width direction of the card.

The thus configured card connector 23 of the embodiment can be used with being surface-mounted on a printed circuit board incorporated in a case of an electronic apparatus such as a portable telephone, while the terminal portions 30*f* of the upper case 30, the external connection terminals 26*c* of the card contacting contacts 26, and the external connection terminals of the pair of metal pieces forming the card recognition switch are mechanically fixed and electrically connected by soldering the printed circuit board.

When the third card 21 is to be attached to the thus configured card connector 23 of the embodiment, the third card 21 is normally inserted from the front end portion 21*b* into the card insertion space 28 through the card insertion port 24 of the connector housing 25 in a state where the rear face (one principal face) of the third card 21 where the contact pads 22 are juxtaposed is positioned on the side of the lower case 29. Then, the third card 21 is fitted between the housing left side wall 30*b* and the slide member 31 while the overhang portion 31*a* of the slide member 31 is fitted into the erroneous insertion preventing cutaway portion 21*d* of the third card 21, and the front end portion 21*b* of the third card 21 butts against the operating portion 31*b* of the slide member 31. When the erroneous insertion preventing cutaway portion 21*d* of the third card 21 passes over the engaging portion 35*a* of the lock spring 35 attached to the slide member 31 in accordance with the normal insertion of the third card 21, the engaging portion 35*a* slides over the side face of the cutaway portion 21*d* to override a side edge portion between the erroneous insertion preventing cutaway portion 21*d* of the third card 21 and the lock cutaway portion 21*e*, while involving deflection toward the outside (right side) of the lock spring 35. Substantially simultaneously with the butting of the front end portion 21*b* of the third card 21 against the operating portion 31*b* of the slide member 31, thereafter, the engaging portion 35*a* is fitted into the lock cutaway portion 21*e* of the third card 21 by the elastic force of the lock spring 35 with being opposed to the lock cutaway portion 21*e* of the third card 21. As a result, the third card 21 and the slide member 31 are engaged and coupled with each other in the card insertion and extraction direction.

When the third card 21 is further inserted, the front end portion 21*b* of the third card 21 pushes rearward the operating portion 31*b* of the slide member 31 to rearward press the slide member 31 against the elastic force of the coil spring 32, and the slide member 31 stops at the extrema pressed position where the slide member butts against the rear stopper portion 29*i*.

In this state, the pressing force on the slide member 31 by the third card 21 is eliminated to release the slide member 31. Then, the slide member 31 is forward pushed back from the extreme pressed position by the elastic force of the coil spring 32, and, in accordance with the push back, also the slide member 31 is forward pushed back.

Figure 17:
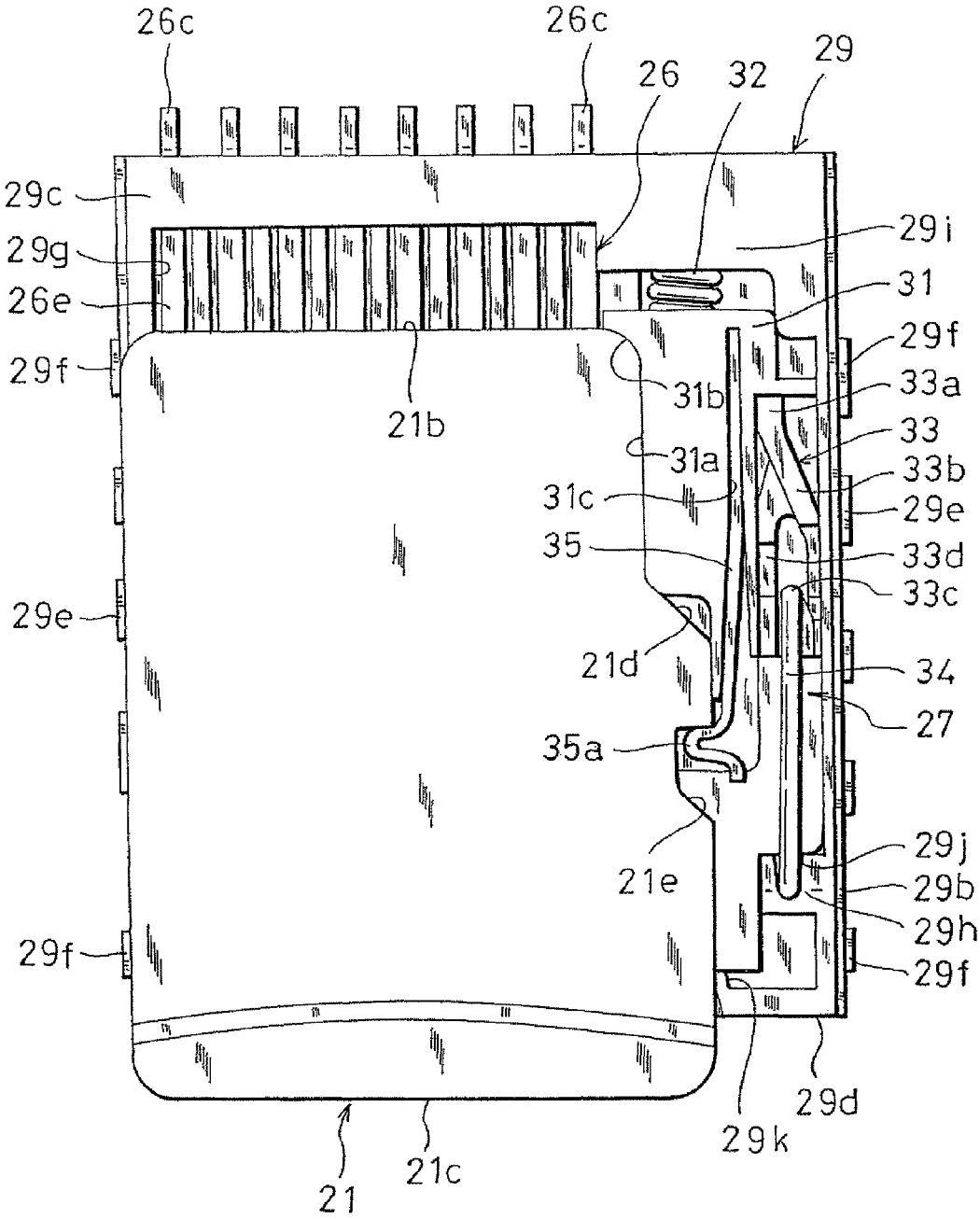
FIG. 17 is a plan view showing an internal structure of a card attachment state of the card connector.

In the above-mentioned series of operations of the slide member 31 beginning at the initial position (the position shown in FIG. 15), the cam pin 34 passes through a forward path 33*b* from a starting portion 33*a* of the cam groove 33, and is introduced into and engaged with an engaging portion 33*c* which is opposite to the starting portion 33*a*. At the timing when the cam pin 34 is engaged with the engaging portion 33*c* of the cam groove 33, the forward movement of the slide member 31 is restricted. As shown in FIG. 17, this causes the slide member 31 to be held to the card attaching position which is slightly in front of the extreme pressed position, and the third card 21 which is engaged and coupled with the slide member 31 in the card insertion and extraction direction is held to the card attaching position and attached to the connector housing 25.

When the third card 21 is normally inserted into the card insertion space 28 of the connector housing 25, the first plate spring piece portions 26*e* of the card contacting contacts 26 extend continuously and substantially horizontally in a cantilevered manner from the first fulcrum portions 26*d* in the direction opposite to the card insertion direction, in the plural contact housing grooves 29*g* which are juxtaposed on the side of the rear end portion (inner side) of the bottom face of the card insertion space 28, in the state where the first fulcrum portions 26*d* disposed in the one (basal) side butt against the rear end portions of the bottom faces of the contact housing grooves 29*g*, and the gaps which are gradually increased as more advancing toward the other end sides (free-end sides) of the first plate spring piece portions 26*e* are formed between the first plate spring piece portions 26*e* preceding the first fulcrum portions 26*d* and the bottom faces of the contact housing grooves 29*g*. Furthermore, the second plate spring piece portions 26*g* having the other end sides of the first plate spring piece portions 26*e* which are positioned on the side of the front end portions of the contact housing grooves 29*g*, as the second fulcrum portions 26*f* on one side extend continuously in a diagonally rearward upward direction from the second fulcrum portions 26*f* in a cantilevered manner, and are projectingly placed in parallel on the side of the rear end portion (inner side) of the card insertion space 28 in an inclined state where the front is lower and the rear is higher. Therefore, the lower side of the front end portion 21*b* of the third card 21 is contacted with the inclined surfaces of the second plate spring piece portions 26*g* of the card contacting contacts 26, and then the third card 21 slides to press down the second plate spring piece portions. Therefore, the first plate spring piece portions 26*e* of the card contacting contacts 26 are downward flexurally deformed with setting the first fulcrum portions 26*d* butting against the rear end portions of the bottom faces of the contact housing grooves 29*g*, as fulcrums, and butt against the bottom faces of the contact housing grooves 29*g*. Then, the second plate spring piece portions 26*g* of the card contacting contacts 26 are downward flexurally deformed with setting the second fulcrum portions 26*f* butting against the front end portions of the bottom faces of the contact housing grooves 29*g*, as fulcrums. Then, the lower side of the front end portion 21*b* of the third card 21 passes over the contacting portions 26*h* of the card contacting contacts 26, the third card 21 overrides the flexurally deformed first and second plate spring piece portions 26*e*, 26*g* of the card contacting contacts 26, and the contacting portions 26*h* of the card contacting contacts 26 are pressed and contacted from the lower side against the contact pads 22 juxtaposed on the rear face (one principal face) of the third card 21, by the elastic forces of the first and second plate spring piece portions 26*e*, 26*g*. As a result, the contact pads 22 of the third card 21 attached on the connector housing 25 are electrically connected by the card contacting contacts 26 to an electronic apparatus (an electronic apparatus in which the card connector 23 of the embodiment is mounted on a printed circuit board) such as a portable telephone, to allow signals to be transmitted between the card and the electronic apparatus. The displacing operations of the first and second plate spring piece portions 26*e*, 26*g* of the above-described card contacting contacts 26 in the card connector 23 of the embodiment are identical with those of the first and second plate spring piece portions 11*c*, 11*e* of the card contacting contacts 11 in the card adaptor 3 shown in FIGS. 11 and 12. Therefore, their illustration is omitted.

By contrast, when, in the card attachment state shown in FIG. 17, a pushing operation is performed on the third card 21, the front end portion 21*b* of the third card 21 pushes rearward (toward the inner side) the slide member 31 to rearward press the slide member 31 from the card attaching position, and the slide member 31 is again pushed to stop at the extreme pressed position where the slide member butts against the rear stopper portion 29*i*. The operation of the slide member 31 from the card attaching position to the extreme pressed position causes the cam pin 34 to be disengaged from the engaging portion 33*c* of the cam groove 33 and introduced into a return path 33*d* to cancel the position holding of the slide member 31. When the pressing force on the slide member 31 by the third card 21 is thereafter eliminated to release the slide member 31, the slide member 31 is forward pushed back from the extreme pressed position to return to the initial position while the front end portion 21*b* of the third card 21 is forward pushed by the operating portion 31*b* by means of the elastic force of the coil spring 32, and the third card 21 is extracted. The cam pin 34 passes through the return path 33*d* and returns to the starting portion 33*a* of the cam groove 33. In accordance with the extraction of the card 21, at the timing when the lower side of the front end portion 21*b* of the third card 21 separates from the inclined surfaces of the second plate spring piece portions 26*g* of the card contacting contacts 26, the depressing of the third card 21 is cancelled, whereby the second plate spring piece portions 26*g* are returned to the original shape by their elastic forces with using the second fulcrum portions 26*f* as fulcrums. Thereafter, the first plate spring piece portions 26*e* are returned to the original shape, and returned to the free state.

When, in the third card 21 extracted by the card extraction mechanism 27, the rear end portion 21*c* of the card 21 projected from the card insertion port 24 to the outside of the housing 25 is nipped by fingers and pulled, the engaging portion 35*a* of the lock spring 35 slides over the side face of the lock cutaway portion 21*e* of the third card 21, and overrides the side edge portion between the lock cutaway portion 21*e* of the third card 21 and the erroneous insertion preventing cutaway portion 21*d*, while involving deflection toward the outside (right side) of the lock spring 35, and the engaging and coupling of the third card 21 and the slide member 31 in the card insertion and extraction direction is cancelled. As a result, the third card 21 can be pulled out from the connector housing 25 through the card insertion port 24. After the third card 21 is pulled out, the state shown in FIG. 15 is attained.

As seen from the above, the card connector 23 of the embodiment comprises the card contacting contacts 26 each of which is to be placed in the card insertion space 28 and contacted with the contact pad 22 which is disposed on one principal face of the card 21, wherein the first plate spring piece portion 26*e* having the first fulcrum portion 26*d* in one side extends in a cantilevered manner from the first fulcrum portion 26*d* in the direction opposite to the card insertion direction so as to be elastically deformable in the thickness direction of the card, the second plate spring piece portion 26*g* having in one side the second fulcrum portion 26*f* which is the other side of the first plate spring piece portion 26*e* is formed in a shape where the second plate spring piece portion extends at an inclination angle in a cantilevered manner from the second fulcrum portion 26*f* in the card insertion direction so as to be elastically deformable in the card thickness direction, and the other side of the second plate spring piece portion 26*g* is to be contacted with the contact pad 22 of the card 21. Furthermore, the case member for forming the card insertion space 28 constitutes the connector housing 25 having a box-like shape configured by the insulative lower case 29 to which the card contacting contacts 26 are attached, and the conductive upper case 30 which is coveringly attached to the lower case 29.

When each of the card contacting contacts 26 is formed into the above-described shape, the plate spring piece portion (second plate spring piece portion 26*g*) which is to be contacted with the contact pad 22 of the card 21 is configured as the unopposed type in which the portion extends at an inclination angle in a cantilevered manner from the fulcrum portion (second fulcrum portion 26*f*) in the card insertion direction (forward direction). Therefore, the possibility that buckling is caused by insertion of the card 21 can be eliminated, and the contact pressure can be increased or decreased in accordance with increase or decrease of the displacement amount of the contact 26. Consequently, a sufficient contact pressure can be ensured even when the spring constant of the contact 26 is not increased, the range of a displacement amount where an adequate contact pressure can be obtained is not narrowed (see FIG. 18), and it is not required to strictly manage the position of the contacting portion 26*h* to suppress dispersions. As a result, a stable contact pressure of the contact 26 can be easily ensured. Structurally, a stress can be dispersed to two portions (the first fulcrum portion 26*d* of the first plate spring piece portion 26*e* and the second fulcrum portion 26*f* of the second plate spring piece portion 26*g*), and in addition a generated stress can be suppressed to a low level by not increasing the spring constant. This stress relaxation can prolong the life period of the contact 26. Therefore, a long life period of the contact 26 can be easily ensured.

The second plate spring piece portion 26*g* may be formed in a shape where it is folded back from the other side of the first plate spring piece portion 26*e*. Alternatively, the second plate spring piece portion 26*g* may be formed by partly cutting and raising the first plate spring piece portion 26*e*, thereby allowing the second plate spring piece portion 26*g* to directly extend at an inclination angle in a cantilevered manner from the other side of the first plate spring piece portion 26*e* in the card insertion direction (forward direction), without passing through a folded back portion (radius of curvature). Therefore, a larger displacement amount of the contact 26 can be obtained, and a stable contact pressure of the contact 26 can be ensured more easily.

According to the card connector 23 of the embodiment, therefore, a stable contact pressure and a long life period can be easily ensured in the contact 26 for card contact disposed in the card connector.

Although, in the above, an example of a preferred embodiment of the contact of the invention, and a card adaptor and card connector having it has been described, the invention is not restricted to this, and can be variously embodied without departing from the spirit of the invention.

What is claimed is:

1. A card connector, comprising:

an insulator member;

contacts positioned in said insulator member and being placed in a card insertion space and contacted with contact pads which are disposed on one principal face of an inserted card; and wherein each of the contacts comprises a first plate spring piece portion having a first fulcrum portion in one side of said insulator member and extends in a cantilevered manner from said first fulcrum portion in a direction opposite to a card insertion direction so as to be elastically deformable in a thickness direction of said card, and a second plate spring piece portion having in one side a second fulcrum portion which is connected from another side of said first plate spring piece portion is formed in a shape where said second plate spring piece portion extends at an inclination angle in a cantilevered manner from said second fulcrum portion in the card insertion direction so as to be elastically deformable in the card thickness direction, and another side of said second plate spring piece portion is to be contacted with said contact pad of said inserted card; and wherein:

a case member forming said card insertion space comprises a connector housing having a box-like shape configured by an insulative lower case to which said contacts are attached, and a conductive upper case which is coveringly attached to said lower case.

* * * * *